US007971549B2

(12) United States Patent
Skillern et al.

(10) Patent No.: US 7,971,549 B2
(45) Date of Patent: Jul. 5, 2011

(54) HYDRATION SYSTEM FOR KAYAK INTEGRATION

(75) Inventors: Jeff Skillern, Boise, ID (US); James H. Sadler, Huntington, VT (US)

(73) Assignee: Oakley, Inc., Fotthill Ranch, CA (US)

( * ) Notice: Subject to any disclaimer, the term of this patent is extended or adjusted under 35 U.S.C. 154(b) by 0 days.

(21) Appl. No.: 12/191,254

(22) Filed: Aug. 13, 2008

(65) Prior Publication Data

US 2008/0308032 A1 Dec. 18, 2008

Related U.S. Application Data

(63) Continuation-in-part of application No. 11/764,620, filed on Jun. 18, 2007.

(60) Provisional application No. 60/955,599, filed on Aug. 13, 2007.

(51) Int. Cl.
*B63B 17/00* (2006.01)

(52) U.S. Cl. ..... 114/347; 114/364; 114/363

(58) Field of Classification Search ..... 114/343, 114/347, 364; 224/148.1, 148.2; 220/703; 222/94, 95, 105, 146.6, 209, 386.5, 389, 222/400.5, 400.7, 400.8

See application file for complete search history.

(56) References Cited

U.S. PATENT DOCUMENTS

| | | | | |
|---|---|---|---|---|
| 3,309,890 | A | 3/1967 | Barnett et al. | |
| 3,677,443 | A | 7/1972 | Smadar et al. | |
| 4,420,097 | A | 12/1983 | Motsenbocker | |
| 4,629,098 | A | 12/1986 | Eger | |
| 4,998,415 | A | 3/1991 | Larsen | |
| 5,062,591 | A | 11/1991 | Runkel | |
| 5,282,557 | A | 2/1994 | McCook | |
| 5,447,039 | A | 9/1995 | Allison | |
| 5,913,456 | A | 6/1999 | Dikeman | |
| 5,940,880 | A | 8/1999 | Phillips | |
| 6,581,538 | B2 | 6/2003 | Sorensen | |
| 2002/0166493 | A1 * | 11/2002 | Sorensen | 114/343 |
| 2006/0144862 | A1 | 7/2006 | Reichert et al. | |

(Continued)

OTHER PUBLICATIONS

U.S. Appl. No. 12/322,995, filed Feb. 9, 2009.

(Continued)

*Primary Examiner* — Ed Swinehart
(74) *Attorney, Agent, or Firm* — Knobbe Martens Olson & Bear LLP

(57) ABSTRACT

A hydration system for kayak integration includes a deck port configured to allow fluid passage through a deck of a kayak. The system includes a reservoir having an internal sealable compartment configured to contain a liquid under pressure. The reservoir has a first port configured to receive pressurizing gasses into the compartment, a second port, and a third port through which the liquid can be supplied into the compartment. A transfer tube couples the reservoir to the deck port. The transfer tube has a first end configured to be coupled to the second port of the reservoir and a second end configured to be coupled to the deck port at a position within an interior space of the kayak. A pressurizer is configured to be coupled to the first port of the reservoir. The pressurizer is operable to supply the pressurizing gasses. A drinking tube has a first end with a valve and a second end. The second end is configured to be coupled to the deck port at a position exterior to the kayak. When the compartment is sealed and pressurized, activation of the valve unseals the compartment and allows the liquid to be expelled from the compartment via the second port, the transfer tube, and the drinking tube as a result of the pressurization of the compartment by the pressurizing gasses.

18 Claims, 19 Drawing Sheets

U.S. PATENT DOCUMENTS

| | | | |
|---|---|---|---|
| 2006/0144863 | A1 | 7/2006 | Reichert et al. |
| 2007/0164037 | A1 | 7/2007 | Chen |
| 2008/0029561 | A1 | 2/2008 | Reichert et al. |
| 2008/0308578 | A1 | 12/2008 | Skillern et al. |
| 2009/0140005 | A1 | 6/2009 | Reichert et al. |
| 2009/0179046 | A1 | 7/2009 | Reichert et al. |
| 2009/0302261 | A1 | 12/2009 | Skillern |
| 2010/0044396 | A1 | 2/2010 | Skillern |

OTHER PUBLICATIONS

U.S. Appl. No. 11/764,620, filed Jun. 18, 2007, published as 2008-0308578 on Dec. 18, 2008, including its ongoing prosecution history, including office communications dated Sep. 1, 1009 and Mar. 18, 2010.

U.S. Appl. No. 12/322,995, filed Feb. 9, 2009, published as 2009-0302261 on Dec. 10, 2009, including its ongoing prosecution history.

U.S. Appl. No. 12/204,326, filed Sep. 4, 2008, published as 2010-0044396 on Feb. 25, 2010, including its ongoing prosecution history.

International Search Report of Oct. 1, 2009 in International Application No. PCT/US2009/053784 filed on Aug. 13, 2009 from the International Searching Authority 8 pages.

U.S. Provisional Patent Application No. 60/987,741 and cover sheet, filed on Nov. 13, 2007 by Reichert et al., entitled "Pressurized Fluid Delivery System With Filter and Associated Method," in 24 pages.

* cited by examiner

HYDRATION SYSTEM FOR KAYAK INTEGRATION

CLAIM FOR PRIORITY

This application is a continuation in part of U.S. patent application Ser. No. 11/764,620 filed Jun. 18, 2007 (now published as U.S. Patent Application Publication No. 2008-0308578 A1 to Skillern et al.) having the same title, which claims the benefit of U.S. provisional patent application 60/822,273, filed Aug. 14, 2006. This application also claims priority of U.S. provisional patent application No. 60/955, 599 filed Aug. 13, 2007. These and all patents and patent applications referred to herein are hereby expressly incorporated by reference in their entireties herein.

BACKGROUND

Personal hydrations systems help athletes maintain adequate hydration while engaging in strenuous physical activities, such as running, cycling, skiing, hiking, or mountain climbing. These personal hydration systems typically include a bag-like reservoir carried in a back pack or waist pack. A flexible drinking tube connects to the reservoir through an exit port at one end and terminates in a mouthpiece at the other end. The tube is long enough to allow the mouthpiece to be carried in the user's mouth to enable the user to draw water from the reservoir like sucking water through a straw. When low on breath during vigorous exercise, drawing water from the reservoir can prove to be a difficult task.

DESCRIPTION OF THE DRAWINGS

FIG. 1. is a top plan view, while FIG. 2 is a side elevation view.

FIG. 3 is a top plan view. FIGS. 4 and 5 are partial exploded views. FIGS. 6 and 6A are partial cross sectional views. FIG. 7 illustrates a reservoir being filled with a liquid.

DETAILED DESCRIPTION

Introduction: Various embodiments of the present invention assist in expelling liquid from a personal hydration system. The following description is broken into sections. The first provides an example of a conventional hydration system. The second section provides an example of a pressurized hydration system. The third section describes a remote pressurized hydration system. The fourth section describes various balloon pressurized hydration systems. The fifth section discusses manual pressurization, and the last section describes a self-cooling pressurized hydration system.

In the various examples discussed below, the term reservoir is used. While the figures show specific examples of bag like reservoirs, other types of containers such as sports bottles and the like are encompassed by the term reservoir. In short, the term reservoir refers to any object in which a drinking fluid can be sealed. An interesting example of a reservoir discussed below is a kayak seat.

Figure 1:
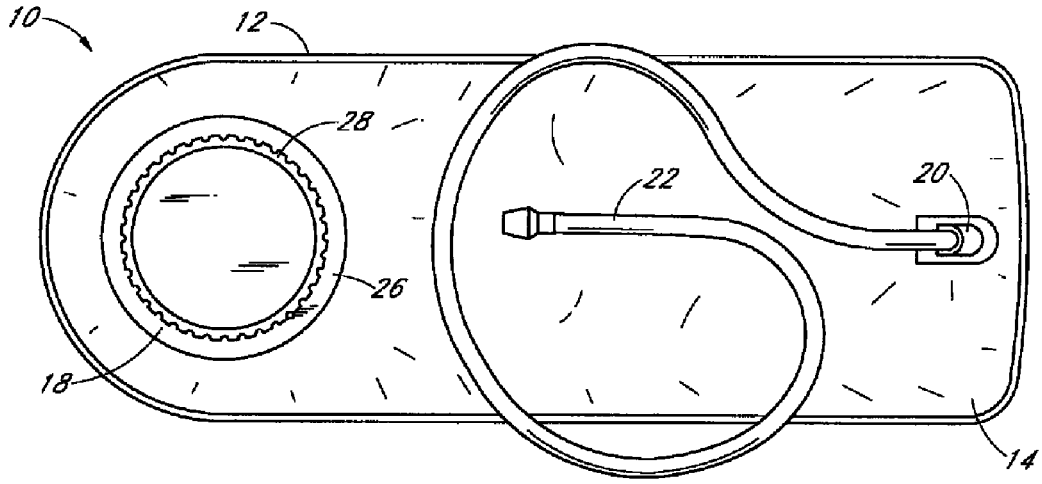
FIG. 1 (PRIOR ART)
FIGS. 1 and 2 illustrates an exemplary a personal hydration system in the form of a reservoir.
Figure 2:
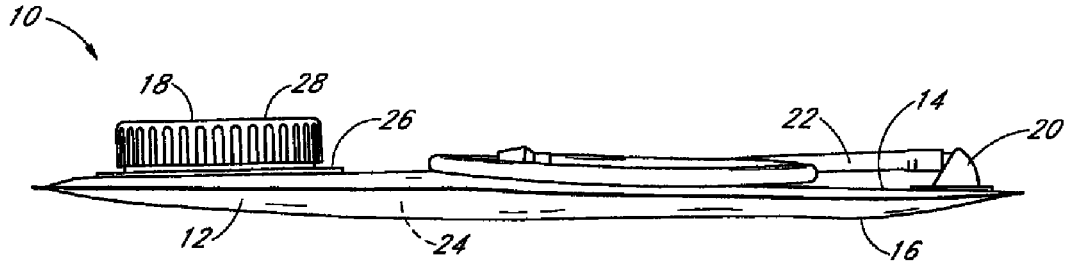
FIG. 2 (PRIOR ART)
Figure 3:
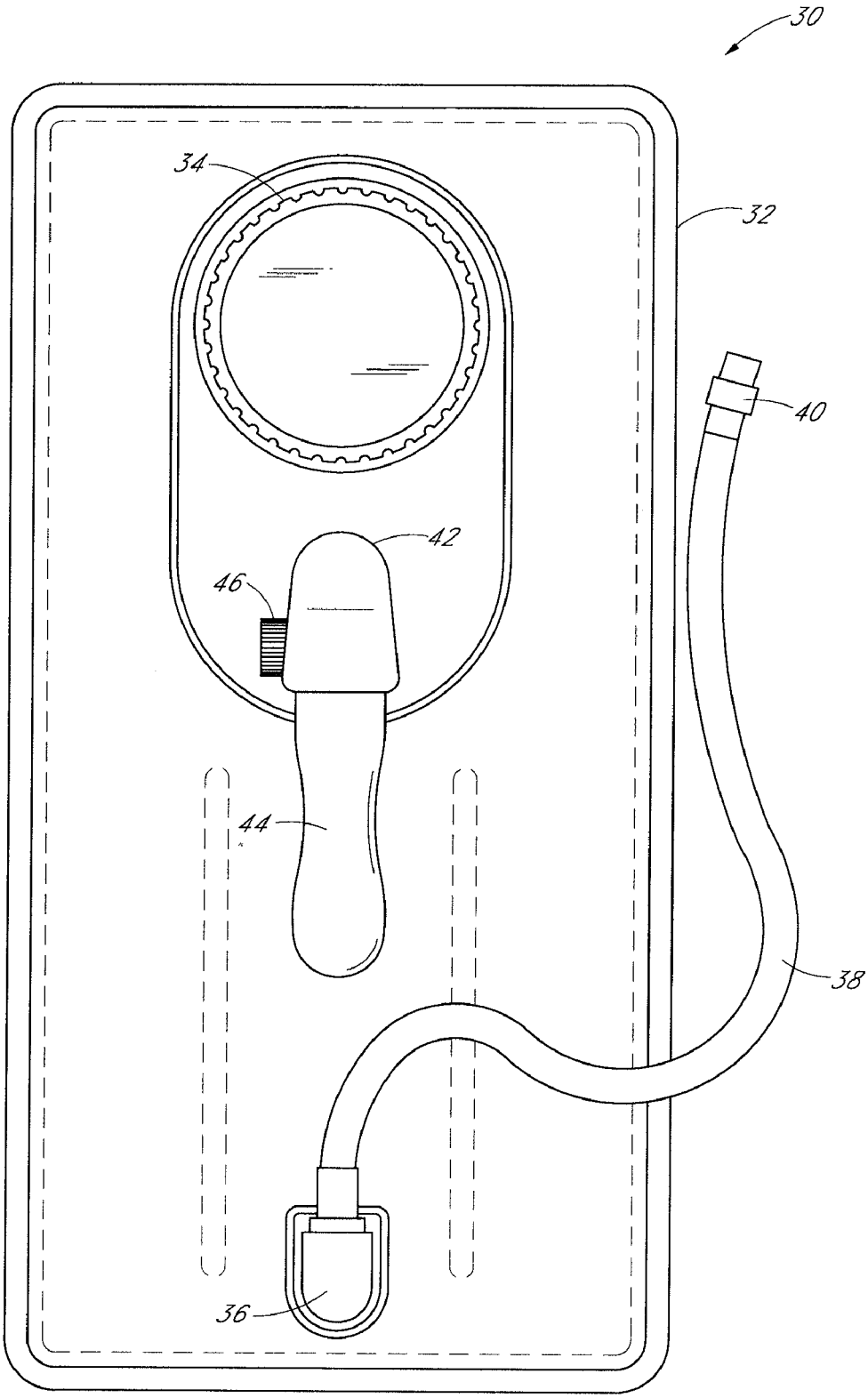
FIGS. 3-7 illustrate a pressurized hydration system.

Non-Pressurized Hydration System: FIGS. 1 and 2 illustrate an exemplary hydration system in the form of reservoir 10. Reservoir 10 includes bladder 12 formed by opposing walls 14 and 16 (seen best in FIG. 2), fill port 18, exit port 20, and drinking tube 22. Walls 14 and 16 form an internal compartment 24 adapted to store a volume of fluid such as water. Walls 14 and 16 can be formed from a flexible, waterproof material. An example of a suitable material is polyurethane, although others may be used. The size and shape of compartment 24 may vary, such as depending upon the desired application with which the system will be used, any pack into which reservoir 10 will be placed, the mechanism by which the reservoir 10 will be transported, and the volume of drink fluid that compartment 24 is designed to hold.

The length of drinking tube 22 may vary depending upon the desired distance between the user's mouth and the location where reservoir 10 is positioned, such as on a user's back, waist, inside a user's garments, on a user's bike or other equipment. An end of drinking tube 22 is connected to reservoir 10 at exit port 20 through which fluid in compartment 24 is received into tube 22. In other words, compartment 24 is in fluid communication with exit port 20.

Reservoir 10 includes fill port 18 through which fluid may be poured into or removed from compartment 24. Fill port 18 also provides an opening through which compartment 24 may be accessed for cleaning. As shown, fill port 18 includes collar 26 and cap 28. Collar 26 is sealed to wall 14. Cap 28 is removeably sealed to collar 26. For example, collar 26 and cap 28 may include mating threads and a gasket allowing cap 28 to be twisted off to be separated from collar 26 and twisted on to be sealed to collar 26. With cap 28 removed, a fluid can be poured into compartment 24 through collar 26 of fill port 18. Cap 28 can then be sealed to collar 26 securing the fluid in compartment 24. User supplied suction applied to drinking tube 22 can then pull the fluid out of compartment 24 through exit port 20.

Pressurized Hydration System: FIGS. 3-7 illustrate an exemplary pressurized hydration system in the form of reservoir 30. In this example, reservoir 30 includes bladder 32 formed by opposing walls 50 and 52 (seen best in FIG. 6), fill port 34, exit port 36, drinking tube 38, and bite valve 40. Walls 50 and 52 form an internal sealable compartment 54 (seen best in FIG. 6) adapted to store a volume of fluid such as water. Walls 50 and 52 can be formed from a flexible, waterproof material. An example of a suitable material is polyurethane, although others may be used. The size and shape of compartment 54 may vary, such as depending upon the desired application with which the system will be used, any pack into which reservoir 30 will be placed, the mechanism by which the reservoir 30 will be transported, and the volume of drink fluid that compartment 54 is designed to hold.

The length of drinking tube 38 may vary depending upon the desired distance between the user's mouth and the location where reservoir 30 is positioned, such as on a user's back, waist, inside a user's garments, on a user's bike or other equipment. An end of drinking tube 38 is connected to reservoir 30 at exit port 36 through which fluid in compartment 54 is received into tube 38. In other words, compartment 54 is in fluid communication with exit port 36.

Reservoir 30 includes fill port 34 through which fluid may be poured into or removed from compartment 54. Reservoir 30 includes pressure port 42 and pressure regulator 46. Pressure port 42 represents an inlet through which a pressurizing gas can enter into compartment 54. Pressurizing gasses can be provided via a pressurizer such as cartridge holder 44 and cartridge 48 (best seen in FIGS. 5 and 6). Cartridge holder 44 is configured to hold and cause cartridge 48 to mate with pressure port 42 in such a manner that pressurizing gas is allowed to expel from cartridge 48 and enter compartment 54. Pressure regulator 46 functions to regulate the level at which internal compartment is pressurized. Pressure regulator 46 may also function as a manual on/off switch and may regulate a rate at which pressurizing gas is allowed to escape cartridge 48 and enter compartment 54.

Once compartment 54 is filled with a liquid and pressurized, activation of bite valve results in the liquid being forced out of compartment 54 through drinking tube 38 and into a person's mouth. In this manner the person utilizing the reservoir 30 need only bite on bite valve 40 and liquid is expelled. The person need not suck to draw liquid from compartment 54.

Figure 4:
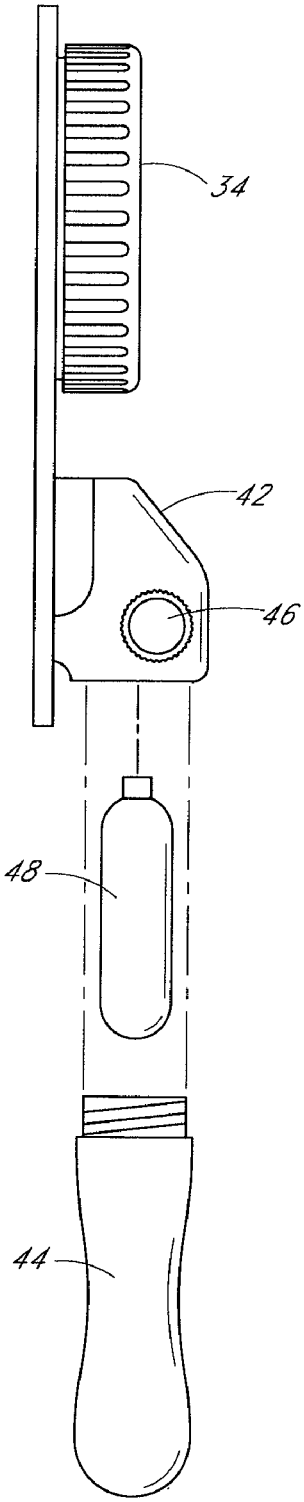
Figure 5:
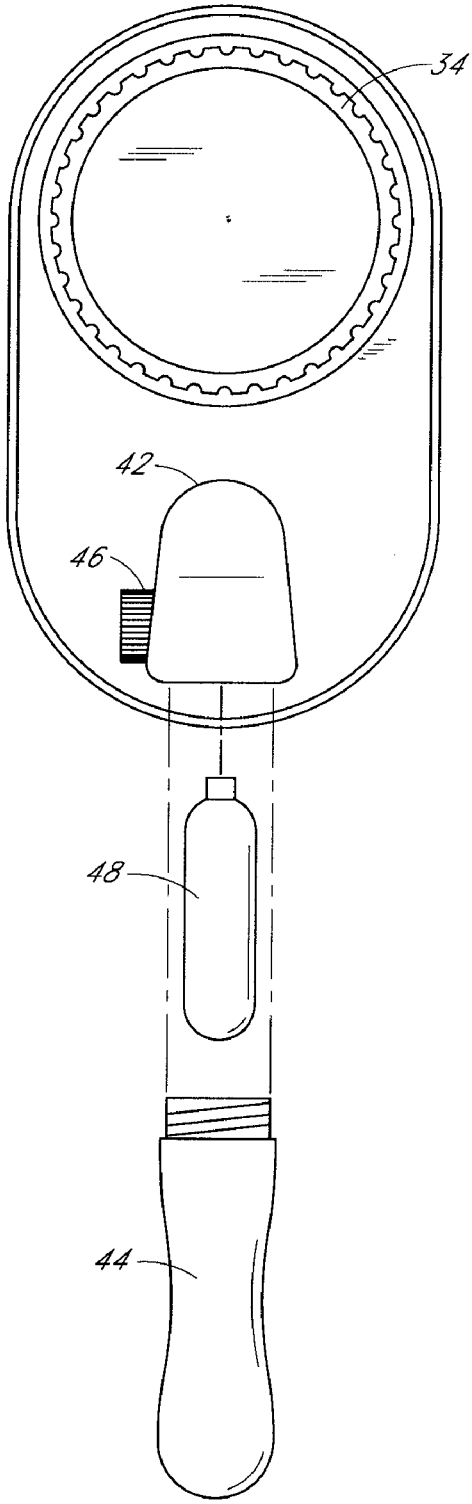

Focusing on FIGS. 4 and 5, cartridge 48 is shown to fit inside cartridge holder 44. Cartridge holder 44 threads into pressure port 42 causing cartridge 48 to engage pressure port 52 allowing pressurizing gas to be expelled from cartridge 48 through pressure port 42 and into compartment 54.

It is noted that fill port 34, exit port 36, and pressure port 42 are shown as being formed in wall 50 such that fill port 34 provides ingress for liquid into compartment 54. Likewise, pressure port 42 provides ingress for pressurizing gasses into compartment 54, and exit port 36 provides an egress for liquid out of compartment 54. While show as being formed in wall 50, one or more of ports 34, 36, and 42 may be formed in wall 52 or elsewhere so long as they provide the noted ingress and egress functions. Furthermore, two or more of ports 34, 36, and 42 may be the same port.

Figure 6:
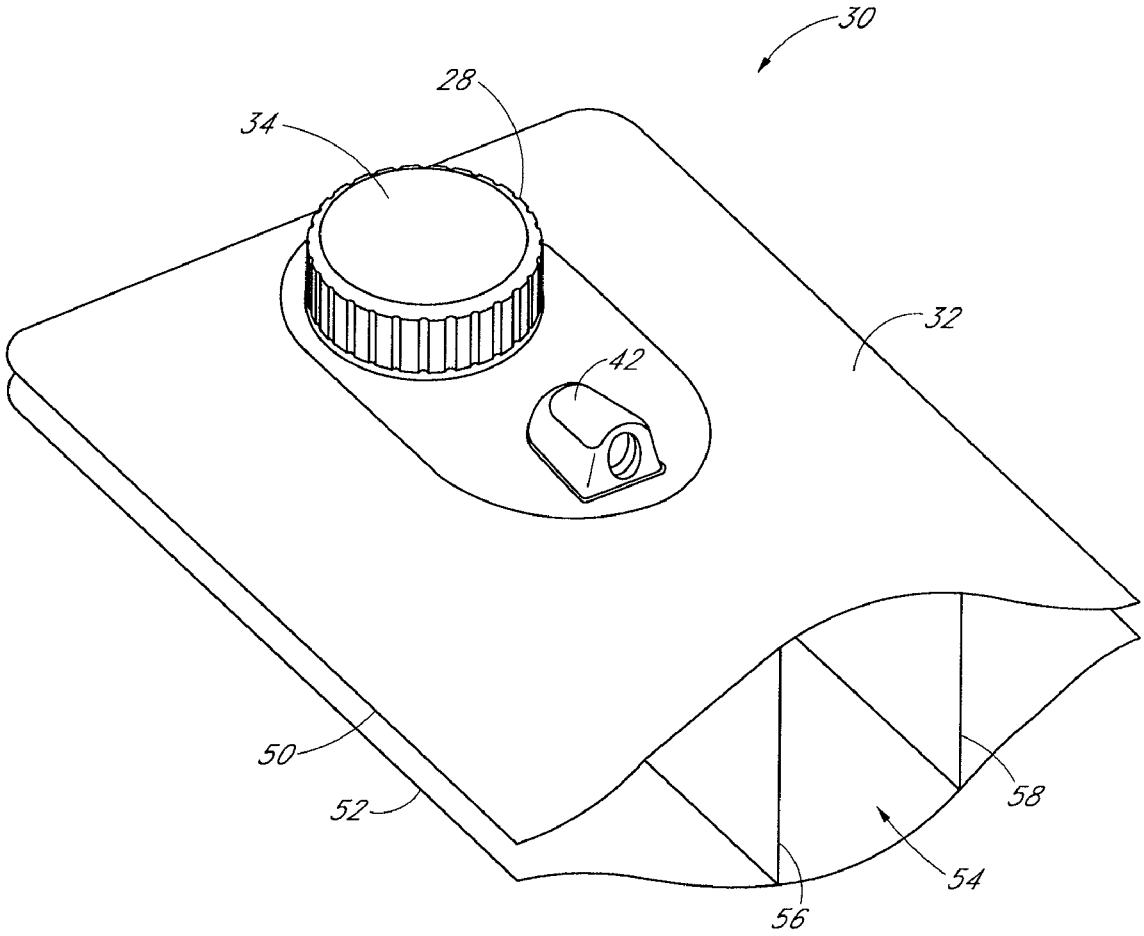
Figure 6A:
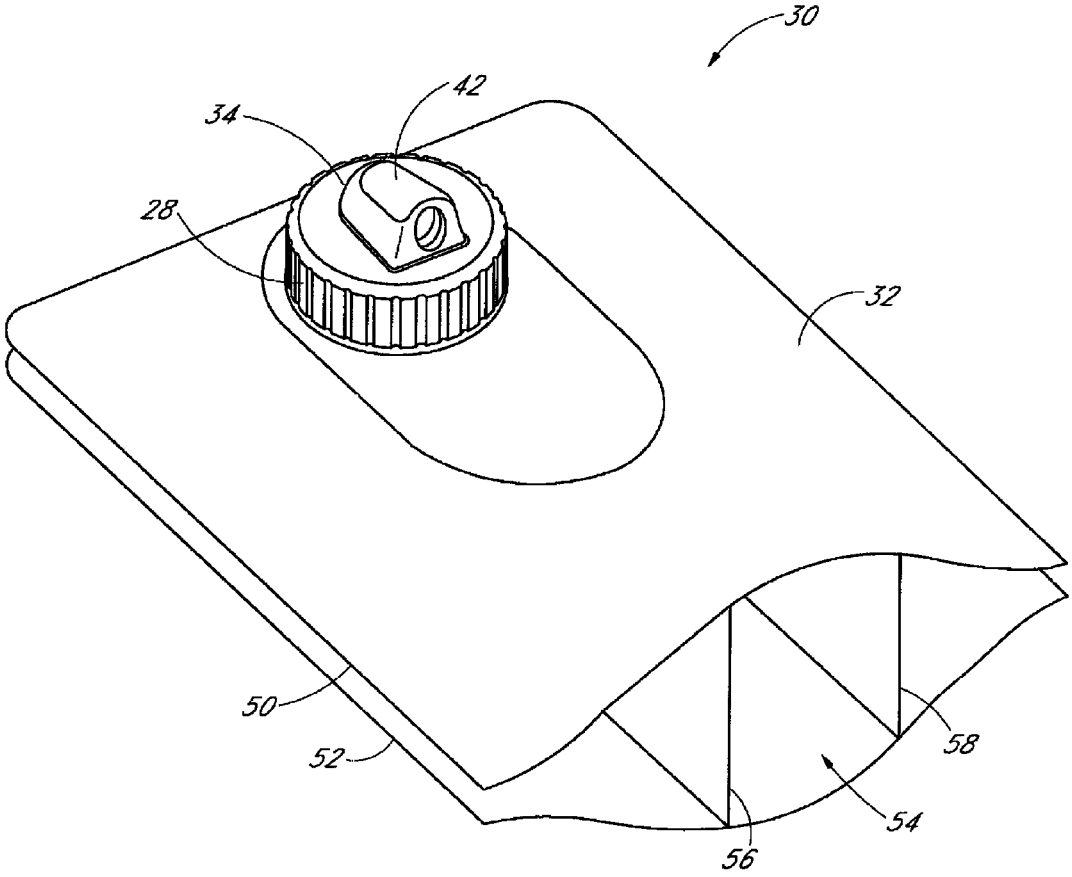
Figure 7:
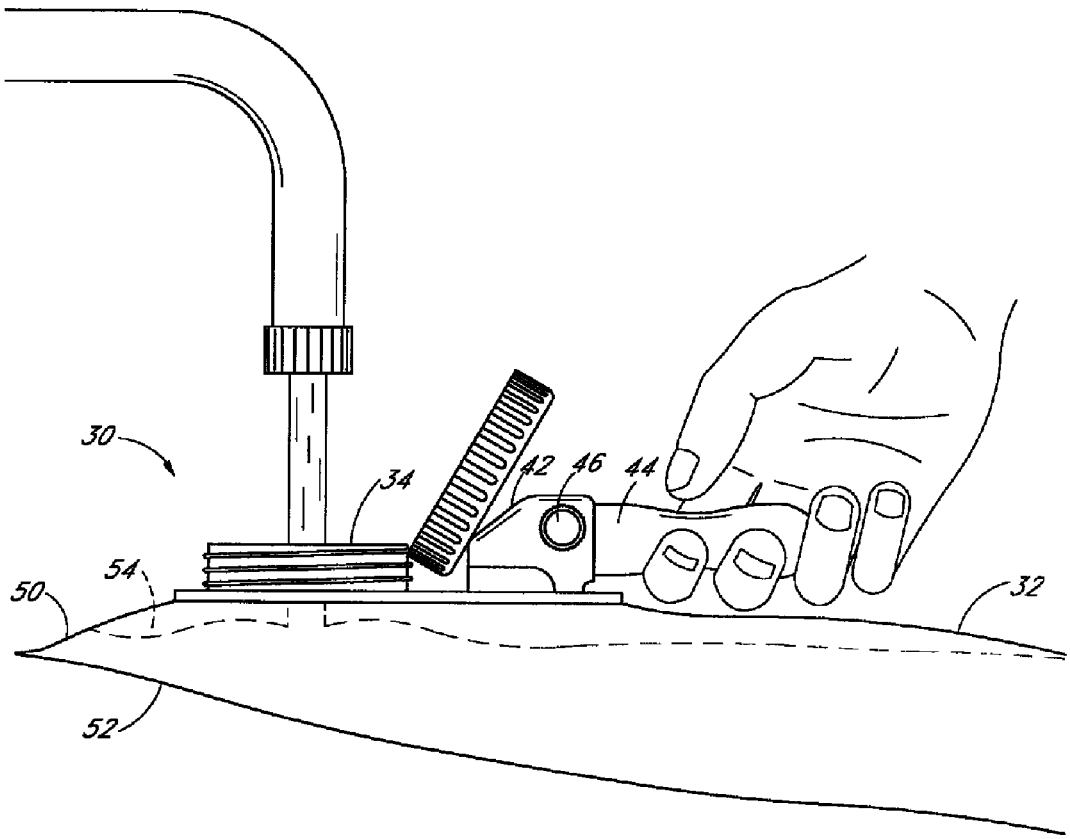

Moving to FIG. 6, reservoir 30 is shown to include baffles 56 and 58 that connect wall 50 to wall 52 within compartment 54. As compartment 54 is pressurized, it tends to expand separating walls 50 and 52. Baffles 56 and 58 operate to oppose expansion or "footballing" of walls 50 and 52 as pressurizing gasses are introduced into compartment 54. FIG. 6A shows an embodiment wherein the fill port 34 includes cap 28 configured to close fill port 34. In this embodiment, the pressure port 42 is formed in cap 28 and is configured to provide an ingress for the pressurizing gasses through cap 28 into the compartment 54 when cap 28 is closing the fill port 34. In FIG. 7, it is shown that cartridge holder 44 can also function as a handle when filling reservoir 30.

Figure 8:
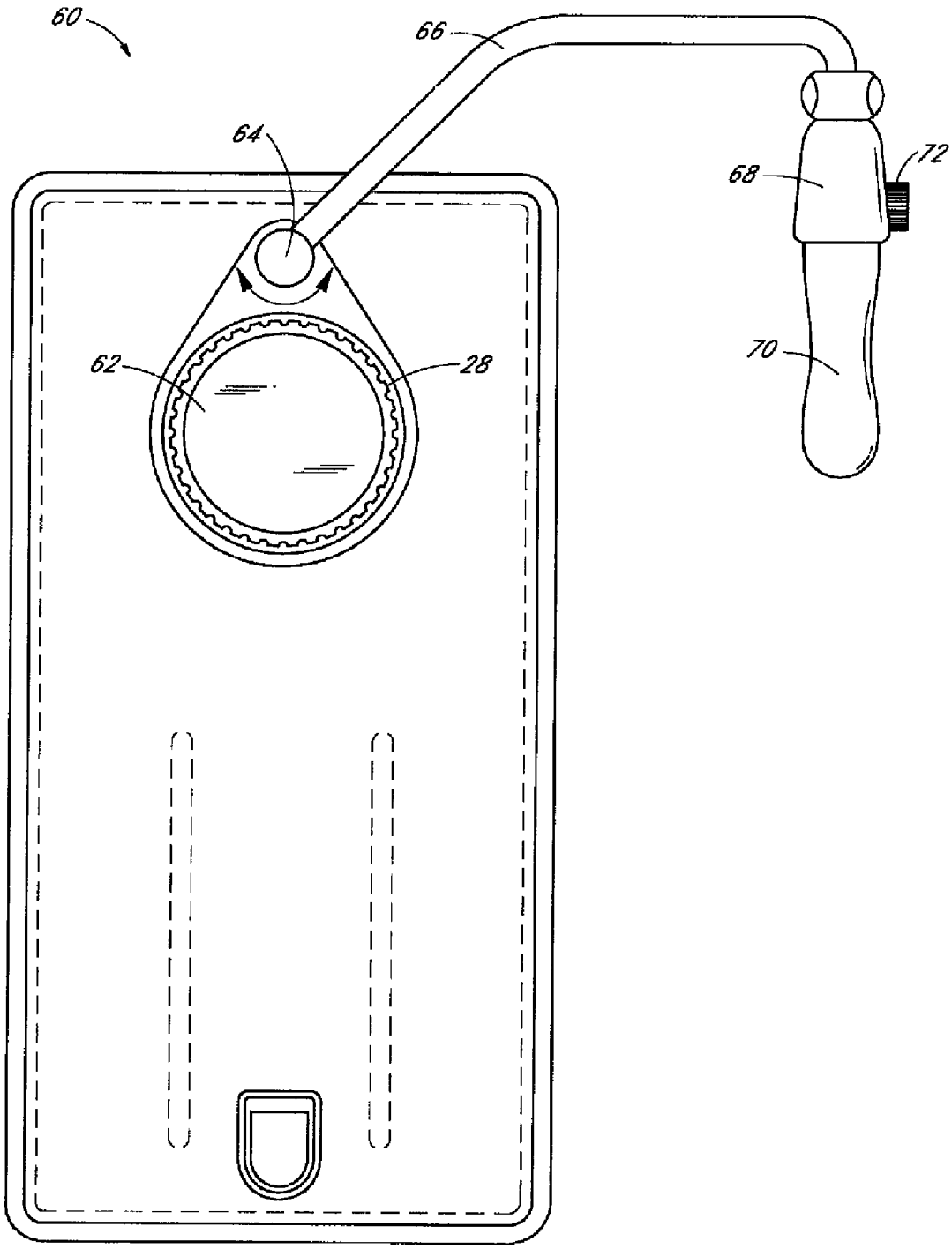
FIG. 8 and FIG. 8A illustrate remote pressurized hydration systems.
Figure 8A:
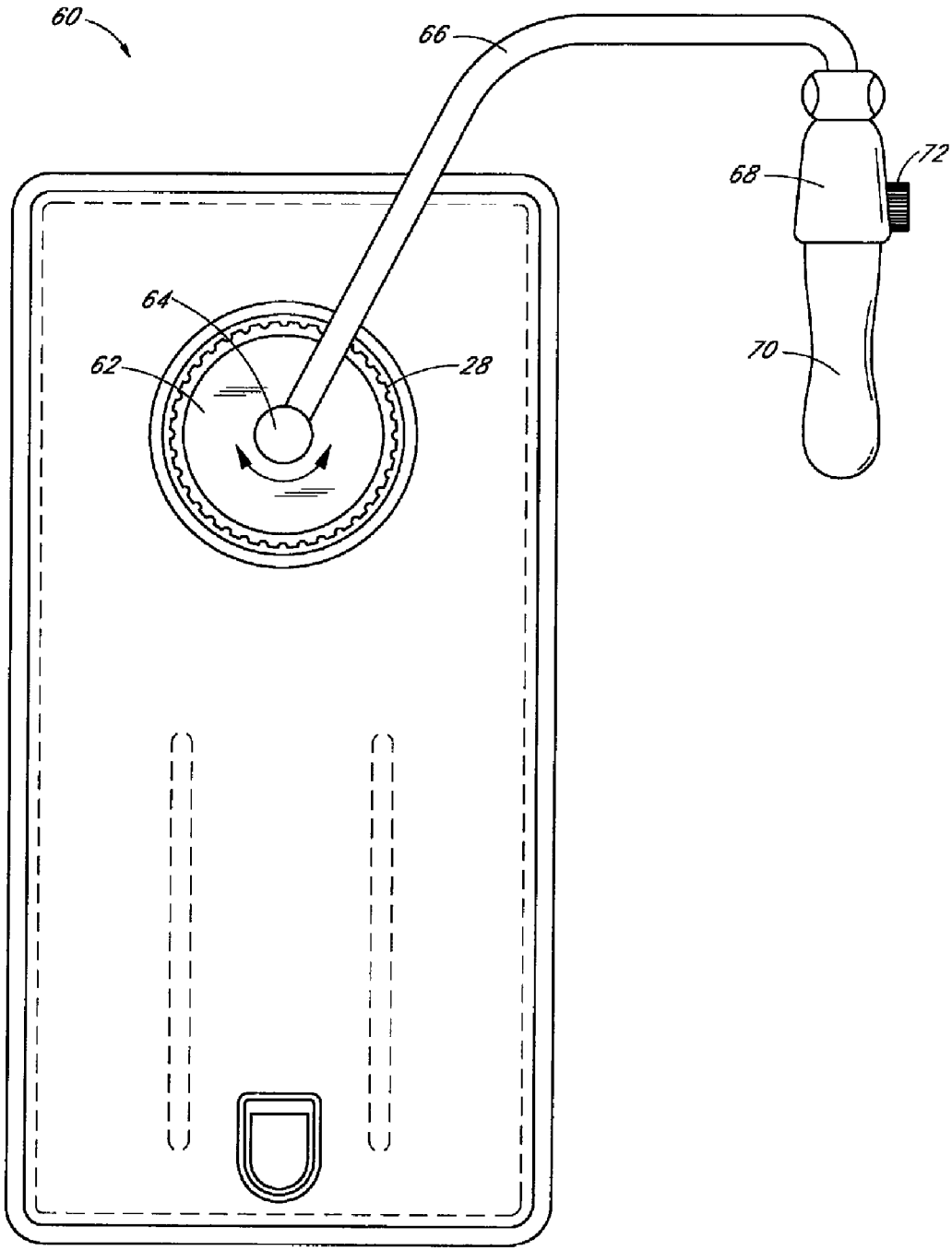

Remote Pressurized Hydration System: FIG. 8 illustrates an exemplary remote pressurized hydration system in the form of reservoir 60. Reservoir 60 includes fill port 62, swivel port 64, transfer tube 66, pressure port 68, cartridge holder 70, and pressure regulator 72. Swivel port 64 serves to provide an input for pressurizing gas into reservoir 60 via transfer tube 66. As its name suggests swivel port 64 swivels allowing transfer tube 66 to rotate about a point. Swivel port 64 may be integrated into fill port 62, such as the embodiment shown in FIG. 8A. For example, fill port 62 is shown to include a cap 28 that closes fill port 62. Swivel port 64 could be formed in that cap 28 such that when fill port 62 is closed, swivel port 64 would provide input for pressurizing gases through the cap 28 and into reservoir 60.

Transfer tube 66 couples pressure port 68 to swivel port 64 and serves as a sealed transfer allowing pressurizing gas to pass from pressure port 68 through swivel port 64, and into reservoir 60. Pressure port 68 represents an inlet through which a pressurizing gas can ultimately be introduced into reservoir 60. Pressurizing gasses can be provided via a cartridge such as cartridge 48 seen in FIGS. 5 and 6. Cartridge holder 70 is configured to hold a cartridge allowing it to mate with pressure port 68 in such a manner that pressurizing gas is allowed to exit the cartridge and enter reservoir 60 via transfer tube 66 and swivel port 64. Pressure regulator 72 functions to regulate the level at which reservoir 60 is pressurized. Pressure regulator 72 may also function as a manual on/off switch and may regulate a rate at which pressurizing gas is allowed to escape a cartridge.

A length of transfer tube 66 is selected to allow for convenient access to pressure port 68 and regulator 72. For example pressure port 68 may be attached to or integrated within a shoulder strap of a backpack used to carry reservoir 60. In this manner, a person can more easily access pressure port 68 and regulator 72 while wearing that backpack.

Balloon Pressurized Hydration System: In the Examples of FIGS. 3-7, reservoir 30 included an internal compartment 54 for containing a liquid. The reservoir 30 is pressurized by introducing pressurizing gas into compartment 54 along with the liquid. FIGS. 9-12 illustrate another embodiment in which pressurizing gas is introduced into a balloon fitted within a reservoir. Expansion of that balloon pressurizes the reservoir.

Figure 9:
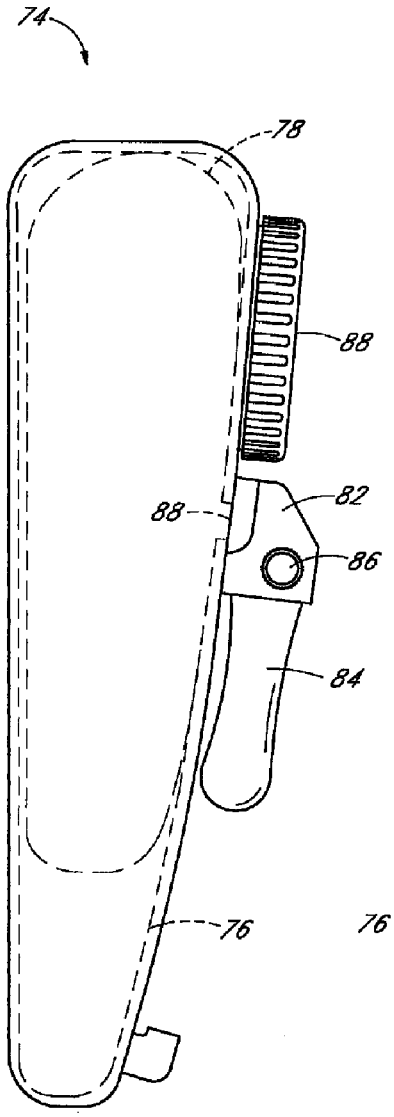
FIGS. 9-12 illustrate balloon pressurized hydration systems.
Figure 10:
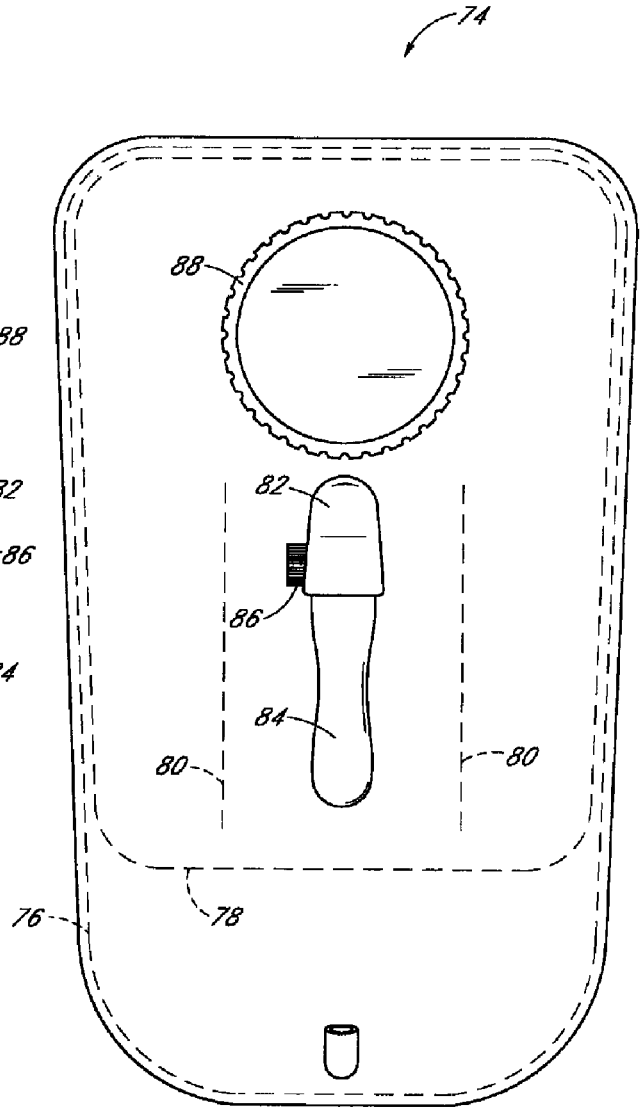

Starting with FIGS. 9 and 10, reservoir 74 includes bladder 76 defining an internal compartment for containing a liquid. Balloon 78 is fitted within that internal compartment with the liquid. Reservoir 74 includes support members 80 designed to help prevent reservoir 78 from "footballing" or over expanding as balloon 78 is pressurized. Reservoir 74 also includes pressure port 82 and pressure regulator 86. Pressure port 82 represents an inlet through which a pressurizing gas can enter into balloon 78 through passage 88. Pressurizing gasses can be provided via a cartridge such as cartridge 48 seen in FIGS. 5 and 6. A cartridge holder 84 is configured to hold and cause the cartridge to mate with pressure port 82 in such a manner that pressurizing gas is allowed to exit the cartridge 48 and enter balloon 78. Pressure regulator 86 functions to regulate the level at which balloon 78 is pressurized. Pressure regulator 86 may also function as a manual on/off switch and may regulate a rate at which pressurizing gas is allowed to escape a cartridge and enter balloon 78. Introduction of pressurizing gas causes balloon 78 to expand pressurizing bladder 76.

Figure 11:
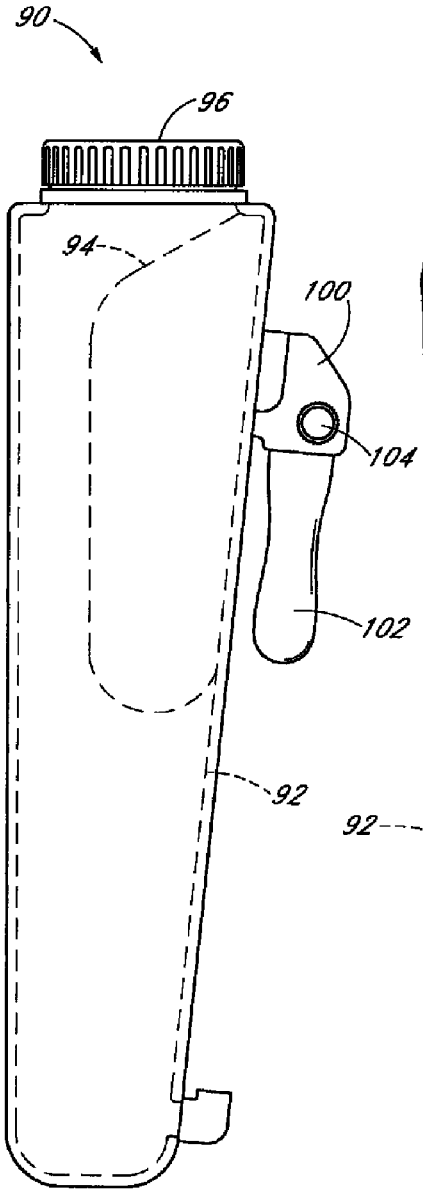
Figure 12:
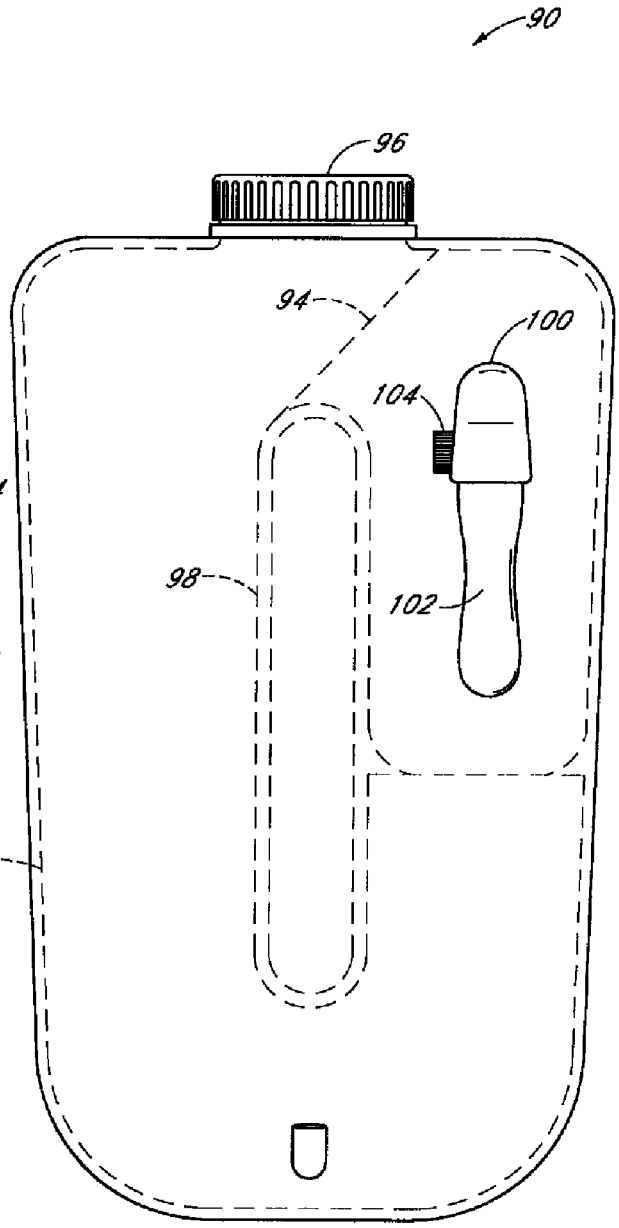

Moving to FIGS. 11 and 12, reservoir 90 includes bladder 92 into which balloon 94 is fitted. Reservoir 90 includes a top located entry port 96 through which liquid can be introduced into an internal compartment of bladder 92. Reservoir 90 includes central support member 98 designed to help prevent reservoir 90 from "footballing" or over expanding as balloon 94 is pressurized. Reservoir 90 also includes pressure port 100 and pressure regulator 104. Pressure port 100 represents an inlet through which a pressurizing gas can enter into balloon 94. Pressurizing gasses can be provided via a cartridge such as cartridge 48 seen in FIGS. 5 and 6. A cartridge holder 102 is configured to hold and cause the cartridge to mate with pressure port 100 in such a manner that pressurizing gas is allowed to exit the cartridge and enter balloon 94. Pressure regulator 104 functions to regulate the level at which balloon 94 is pressurized. Pressure regulator 104 may also function as a manual on/off switch and may regulate a rate at which pressurizing gas is allowed to escape a cartridge and enter balloon 94. Introduction of pressurizing gas causes balloon 94 to expand pressurizing bladder 92.

Figure 13:
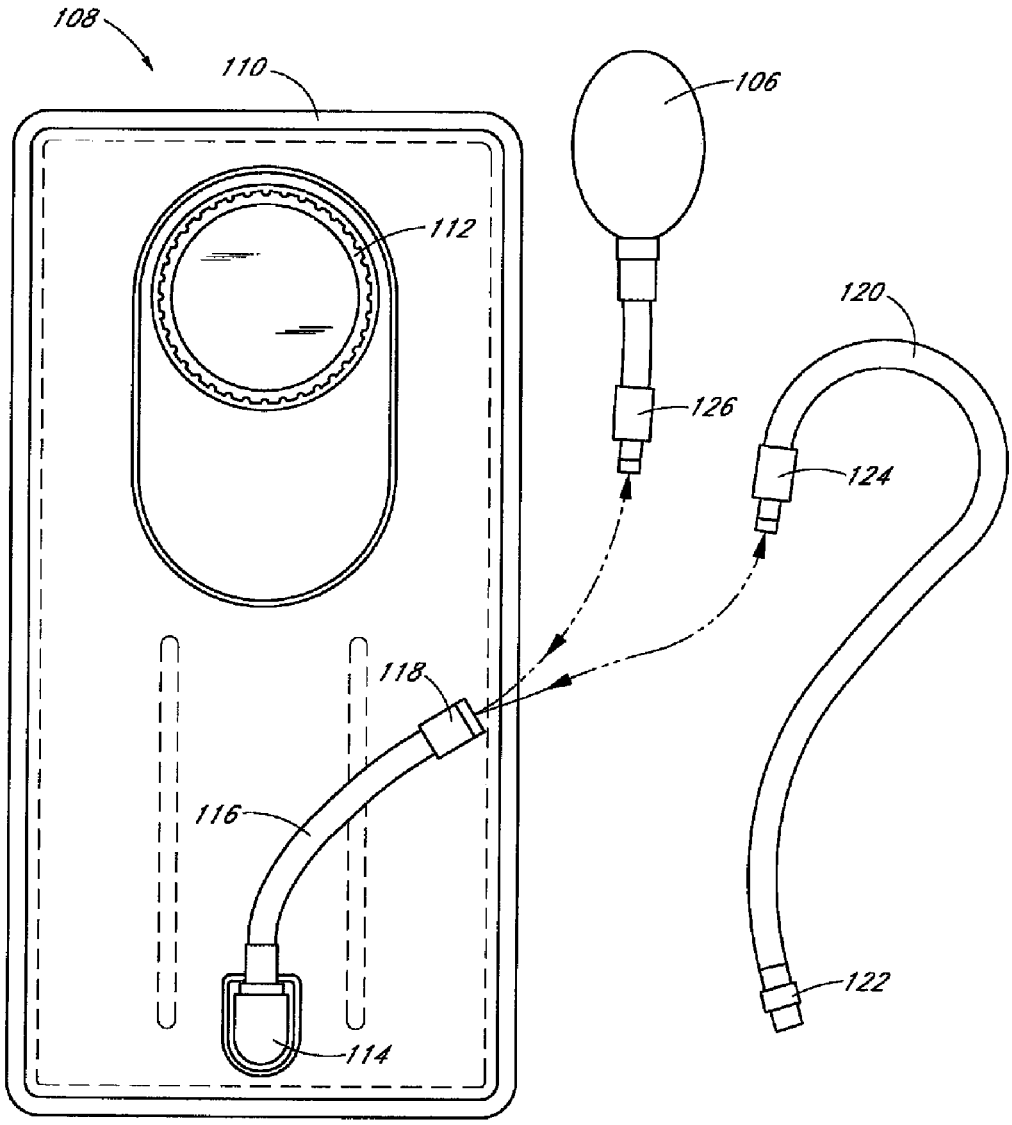
FIGS. 13-14 illustrate manually pressurized hydration systems.
Figure 14:
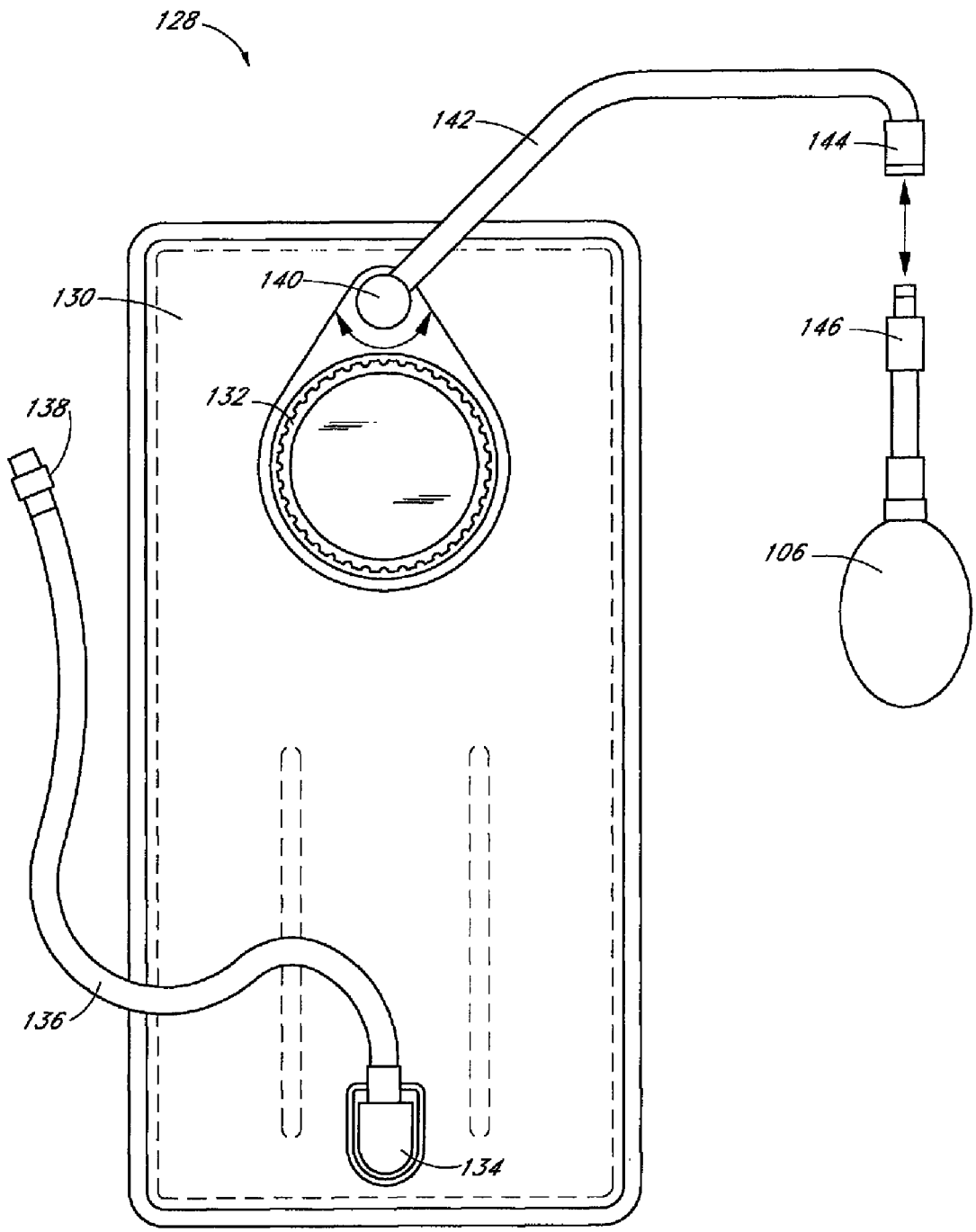

Manual Pressurization: While FIGS. 3-12 illustrate a pressurizer in the form of holder and cartridge such as holder 44 and cartridge 48. Other means for pressurizing are also contemplated. In FIGS. 13 and 14, for example, a pressurizer includes a bulb style pump such as squeeze pump 106.

Referring first to FIG. 13, reservoir 108 includes bladder 110, fill port 112, exit port 114, exit tube 116. One end of exit tube 116 is coupled to exit port 114. The other end of exit tube 116 is shown to include female coupler 118. Also shown are drinking tube 120 and squeeze pump 106. One end of drinking tube 120 includes bite valve 122 while the other end includes male coupler 124. Squeeze pump 106 include male coupler 126. Male couplers 124 and 126 are configured to be removably coupled to female coupler 118. Female coupler 118 includes a check valve (not shown) that is opened when coupled to either one of male couplers 124 or 126 allowing passage of fluids and gasses through female coupler 118. When decoupled, the check valve is closed blocking the passage fluids and gasses through female coupler 118.

Male coupler 126 of squeeze pump 106 can be coupled to and decoupled from female coupler 118 of exit tube 116. When coupled, the repeated manual squeezing of squeeze pump 106 forces pressurizing gas in the form of air into bladder 110 via exit tube 116. Also, male coupler 124 of drinking tube 120 can be coupled to and decoupled from female coupler 118 of exit tube 116. When coupled, fluid contained in bladder 110 is allowed to pass into and through drinking tube 120. In this example, port 114 serves as an exit port through which fluid can exit bladder 110 and as a pressure port through which pressurizing gasses can enter bladder 110.

Once bladder 110 is filled with a liquid and pressurized using squeeze pump 106 and male coupler of drinking tube 124 is coupled to female coupler 118, activation of bite valve 122 results in the liquid being forced out of bladder 110 through exit tube drinking tube 38 and into a person's mouth. In this manner the person utilizing the reservoir 30 need only bite on bite valve 40 and liquid is expelled. The person need not suck to draw liquid from compartment 54.

Referring now to FIG. 14, reservoir 128 includes bladder 130, fill port 132, exit port 134, drinking tube 136, bite valve 138, swivel port 140, transfer tube 142, and female coupler 144. Also shown is squeeze pump 106 which includes male coupler 146 configured to couple to and decoupled from female coupler 144 of transfer tube 142. Female coupler 144 includes a check valve (not shown) that is opened when coupled to male coupler 146 allowing squeezed pump 106 to force pressurizing gasses through transfer tube 140 and into bladder 130. When decoupled, the check valve is closed blocking the passage of fluids and gasses through female coupler 144.

Swivel port 140 serves to provide an input for pressurizing gas into reservoir 128 via transfer tube 142. As its name suggests swivel port 140 swivels allowing transfer tube 142 to rotate about a point. With male coupler 146 of squeeze pump 106 coupled to female coupler 144 of transfer tube 142, the repeated manual squeezing of squeeze pump 106 forces pressurizing gasses in the form of air through transfer tube 142 into bladder 130. While not shown, swivel port 140 may be integrated into fill port 132. For example, fill port 132 is shown to include a cap that closes fill port 132. Swivel port 140 could be formed in that cap such that when fill port 1322 is closed, swivel port 140 would provide input for pressurizing gases through the cap and into bladder 130.

A length of transfer tube 142 is selected to allow for convenient access to squeeze pump 106. For example squeeze pump 106 may be attached to or integrated within a shoulder strap of a backpack used to carry reservoir 128. In this manner, a person can more easily squeeze pump 106 while wearing that backpack.

Once bladder 110 is filled with a liquid and pressurized using squeeze pump 106, activation of bite valve 138 results in the liquid being forced out of bladder 130 through drinking tube 136 and into a person's mouth. In this manner the person utilizing the reservoir 128 need only bite on bite valve 138 and liquid is expelled. The person need not suck to draw liquid from bladder 130.

Figure 15:
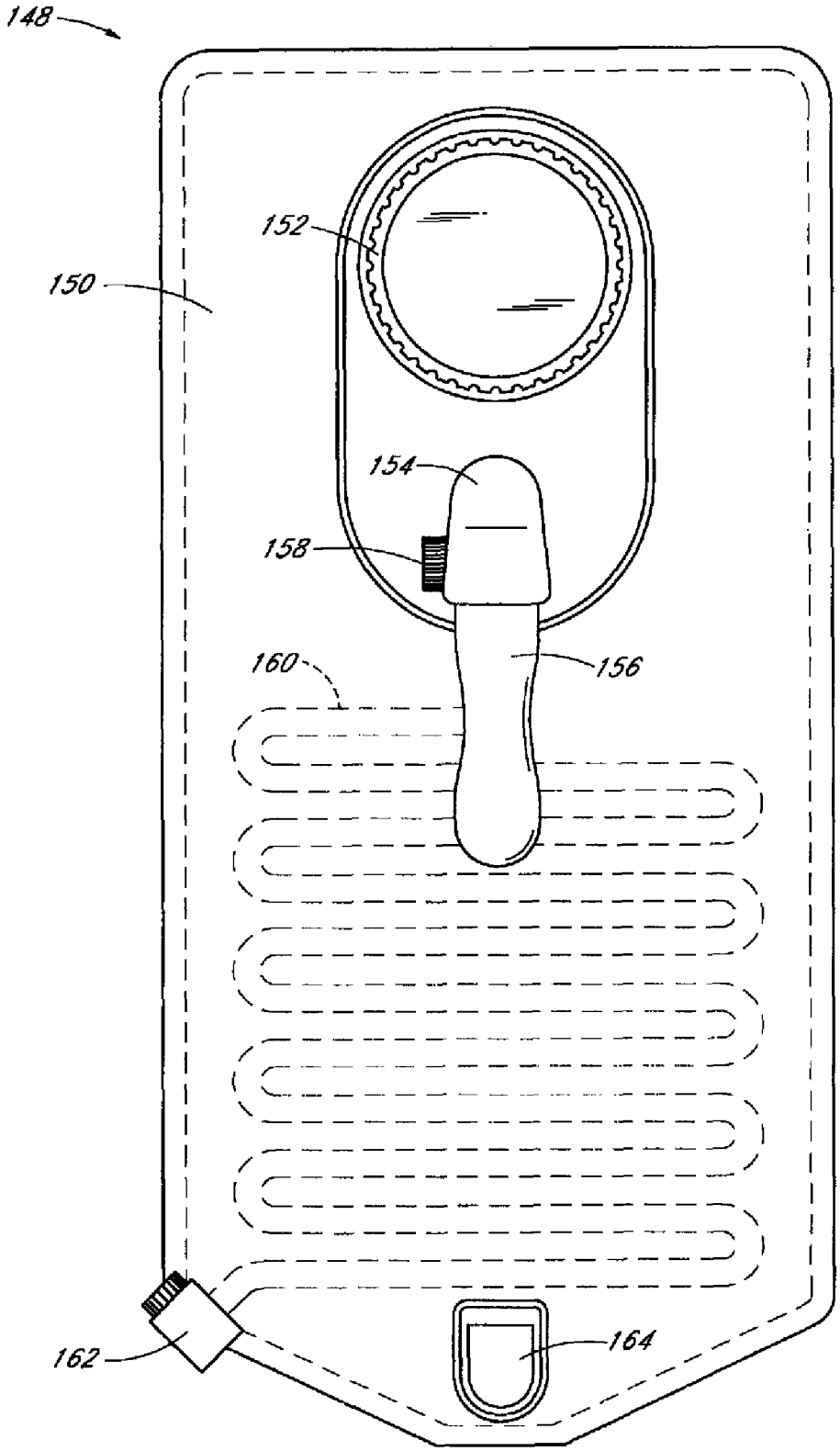
FIGS. 15-16 illustrate self-cooling pressurized hydration systems.

Self Cooling Pressurized Hydration System: FIG. 15 illustrates a reservoir 148 configured for use of a pressurized gas to cool its contents. As illustrated, reservoir 148 includes bladder 150, fill port 148, pressure port 154, cartridge holder 156, transfer coil 160, and gas exit port 162.

Bladder 150 defines an internal compartment for containing a liquid. Fill port 152 provides a sealable opening through which liquid can be introduced into bladder 150. Pressure port 154 represents an inlet through which a pressurizing gas can enter into transfer coil 160. Pressurizing gasses can be provided via a cartridge such as cartridge 48 seen in FIGS. 5 and 6. A cartridge holder 156 is configured to hold and cause the cartridge to mate with pressure port 154 in such a manner that pressurizing gas is allowed to exit the cartridge and enter transfer coil 160. Pressure regulator 158 functions to as a manual on/off switch and may regulate a rate at which pressurizing gas is allowed to escape a cartridge. Introduction of gas from a pressurized cartridge provides a cooling effect on the contents of bladder 150. Gas exit port 162 provides a means of escape for the gas. The winding path of transfer coil 160 provides additional surface area allowing the escaping case to more effectively cool the contents of bladder 150.

Reservoir 148 may be made of a series of adjacent layers of material. A first pair adjacent layers of reservoir 148 form a first internal compartment for holding a liquid. A second pair of adjacent layers form a second internal compartment for holding a cooling gel or other material that can be chilled or frozen to keep the liquid in the first compartment cool. It is noted that the first and second pair of layers may share a common layer such that reservoir 148 is made of three adjacent layers with the center layer being common to each pair of adjacent layers. Transfer coil 164 may be formed between the second pair of layers containing the cooling gel. In this manner, gas escaping a pressurized cartridge and passing through transfer coil 160 can chill the cooling gel.

Figure 16:
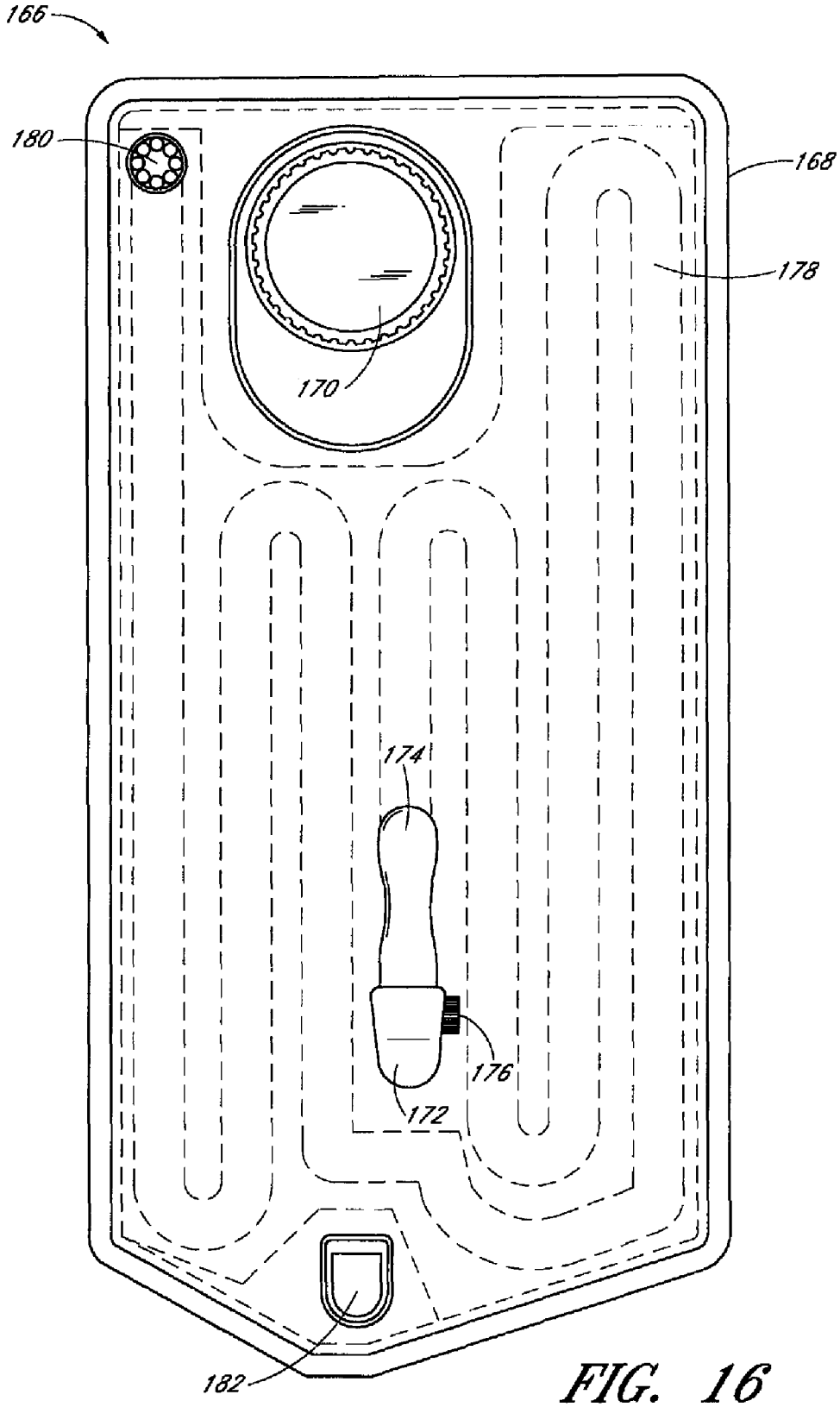

FIG. 16 illustrates a reservoir 166 configured for use of a pressurized gas to cool its contents and to pressurize an internal compartment. As illustrated, reservoir 166 includes bladder 168, fill port 170, pressure port 172, cartridge holder 174, regulator 176, transfer coil 178, and transfer port 180.

Bladder 168 defines an internal compartment for containing a liquid. Fill port 170 provides a sealable opening through which liquid can be introduced into bladder 168. Pressure port 172 represents an inlet through which a pressurizing gas can enter into transfer coil 178. Pressurizing gasses can be provided via a cartridge such as cartridge 48 seen in FIGS. 5 and 6. A cartridge holder 174 is configured to hold and cause the cartridge to mate with pressure port 172 in such a manner that pressurizing gas is allowed to exit the cartridge and enter transfer coil 178. Gases pass through transfer coil 178 and travel through transfer port 180 pressurizing the internal compartment of reservoir 166. Pressure regulator 176 functions to regulate the level at which the internal compartment is pressurized. Pressure regulator 176 may also function as a manual on/off switch and may regulate a rate at which pressurizing gas is allowed to escape a cartridge and enter the internal compartment.

Introduction of gas from a pressurized cartridge provides a cooling effect on the contents of bladder 168. The winding path of transfer coil 178 provides additional surface area allowing the escaping case to more effectively cool the contents of bladder 168. Transfer port 180 provides an internal connection between transfer coil 178 and the internal compartment holding the liquid.

Pressurized Kayak Integrated Hydration System: As discussed above, a pressurized hydration system can be carried on a user's back or waist, inside a user's garments, on a user's bike or other equipment. FIGS. 17-21 illustrate an example in which a pressurized irrigation system is integrated into a kayak.

Figure 17:
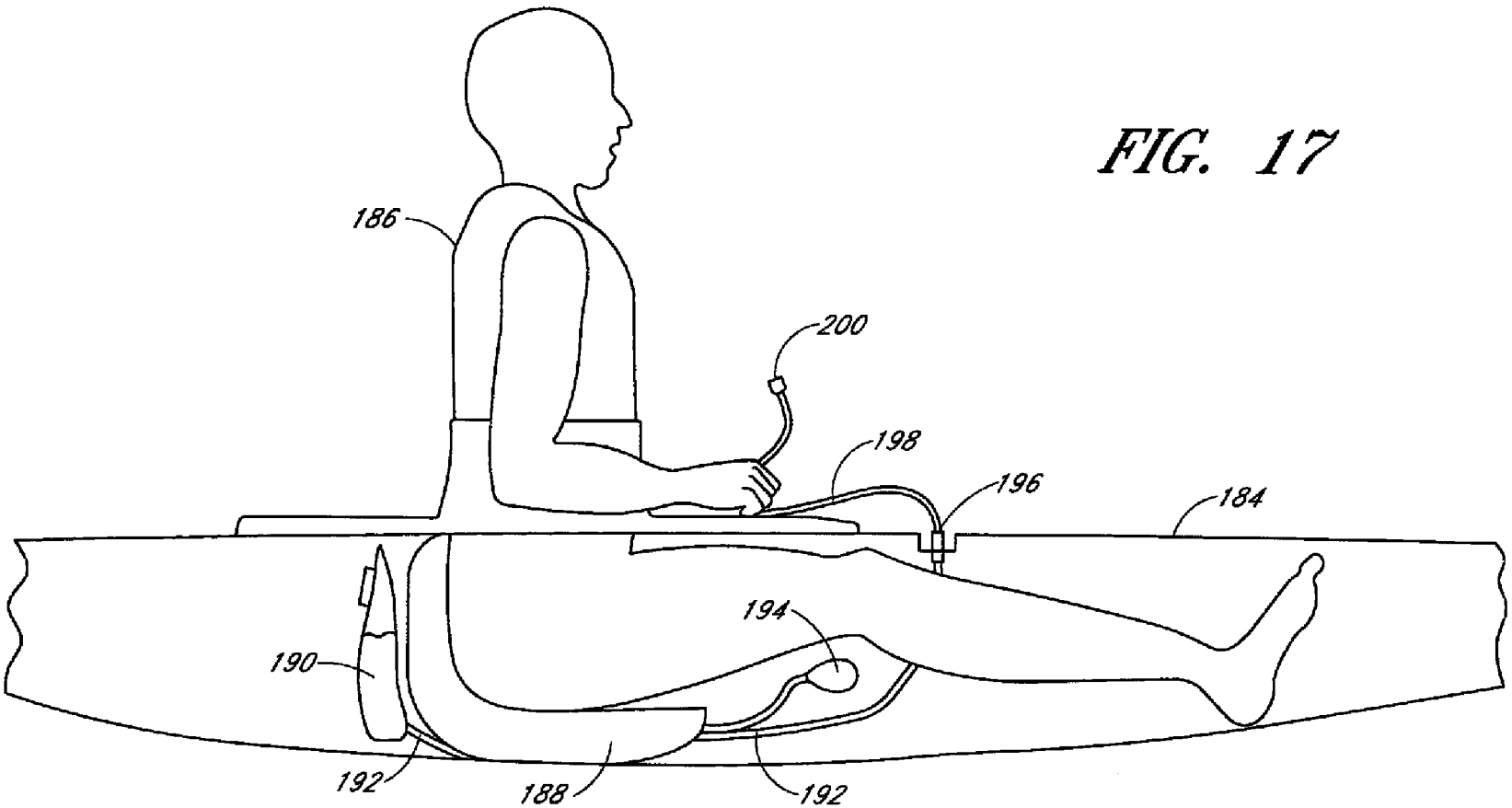
FIGS. 17-21 illustrate pressurized hydration systems integrated into kayaks

FIG. 17 illustrates a kayak 184 and paddler 186. Paddler 186 is sitting on seat 188 with his legs inserted into the kayak. Paddler 186 is wearing a skirt that provides a seal for preventing water from entering the kayak. While serving an important purpose, the skirt prevents paddler 186 from reaching into kayak 184 and retrieving a beverage.

In the example of FIG. 17, reservoir 190 is positioned within kayak 184. While shown as being placed behind seat 188, reservoir 190 can be placed anywhere within the interior of kayak 184. Transfer tube 192 extends from an exit port on reservoir 190. Pressurizer 194 extends from a pressure port on reservoir 190. Prior to sealing himself into kayak 184 with the skirt, paddler 186 can fill reservoir 190 with a liquid through a fill port. Paddler 186 can then pressurize reservoir 190 using pressurizer 194. Here, pressurizer 194 includes a squeeze pump.

Kayak 184 is shown to include a recessed deck port 196 on its forward deck. Deck port 196 represents generally any structure configured to allow fluid to flow from reservoir 190 through transfer tube 192 and pass out of kayak 184. Along these lines, transfer tube 192 is connected to deck port 196 within the interior of kayak 184 creating a fluid flow path between reservoir 190 and deck port 196. Drinking tube 198 connects to deck port 196 outside kayak 196 and includes a valve 200. When reservoir 190 is pressurized, paddler 186 can bite down on valve 200 allowing the liquid contents of reservoir to be forced though tubes 192 and 198 and expelled out of valve 200.

Deck port 196 may include one or more couplers with check valves that are closed unless those couplers are coupled to transfer tube 192 and drinking tube 198. For example, deck port 196 may include an external female coupler with a check valve that is opened when the female coupler is coupled to a male coupler of drinking tube 198. In this manner, when drinking tube 198 is decoupled from deck port 196, the forward deck remains sealed. In other examples, deck port 196 could be replaced with a skirt port, that is, a port formed in the skirt worn by paddler 186.

Figure 18:
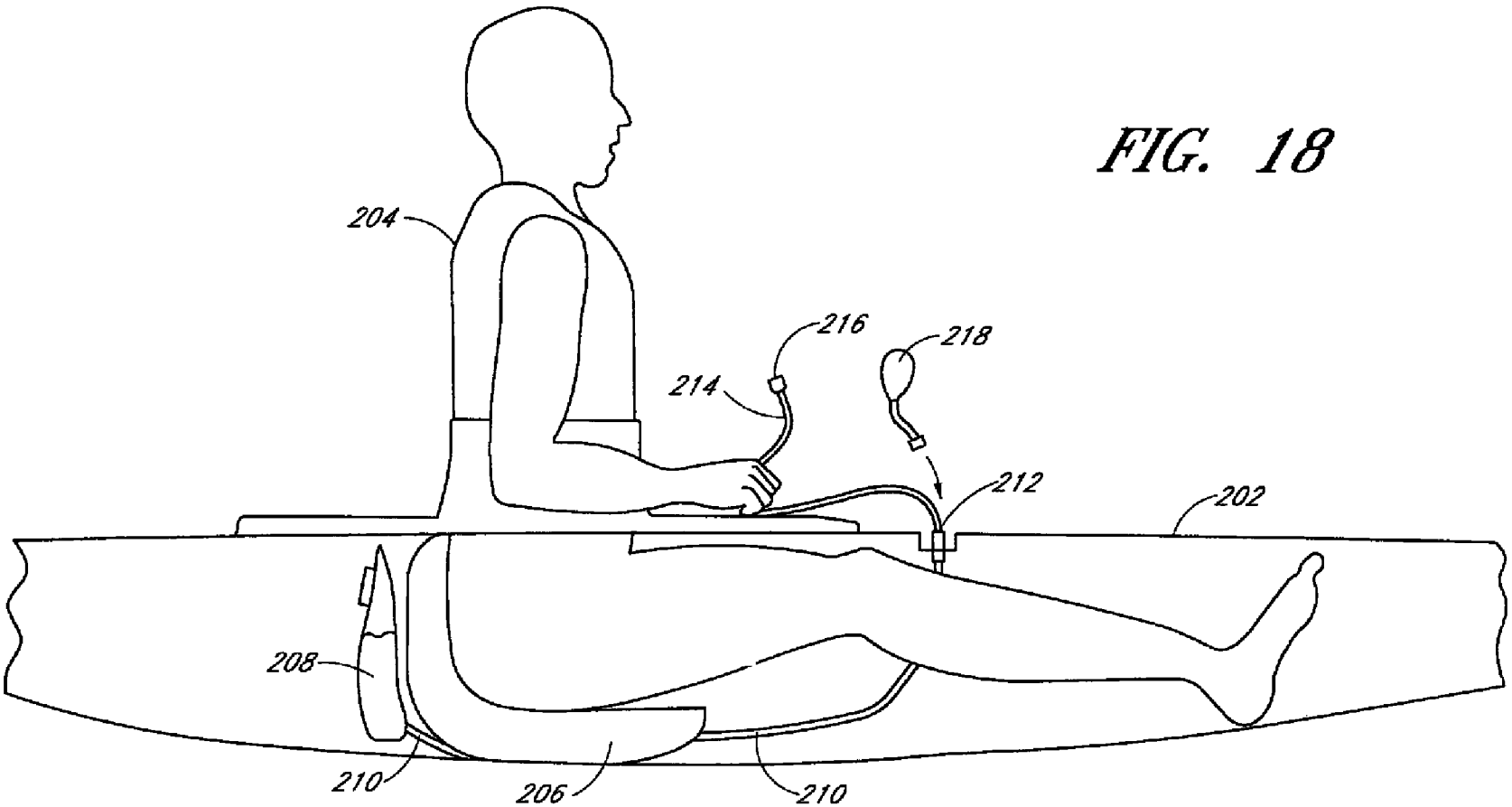

FIG. 18 illustrates a kayak 202 and paddler 204. Paddler 204 is sitting on seat 206 with his legs inserted into the kayak. Paddler 186 is wearing a skirt that provides a seal for preventing water from entering the kayak. While serving an important purpose, the skirt prevents paddler 204 from reaching into kayak 202 and retrieving a beverage.

In the example of FIG. 18, reservoir 208 is positioned within kayak 202. While shown as being placed behind seat 206, reservoir 208 can be placed anywhere within the interior of kayak 202. Transfer tube 210 extends from an exit port on reservoir 208. Kayak 202 is shown to include a recessed deck port 212 on its forward deck. Deck port 212 represents generally any structure configured to allow fluid to flow from reservoir 208 through transfer tube 210 and pass out of kayak 202. Along these lines, transfer tube 210 is connected to deck port 212 within the interior of kayak 202 creating a fluid flow path between reservoir 208 and deck port 212. Drinking tube 214 connects to deck port 212 outside kayak 202 and includes a valve 216. When reservoir 208 is pressurized, paddler 204 can bite down on valve 216 allowing the liquid contents of reservoir 208 to be forced though tubes 210 and 214 and expelled out of valve 216.

Deck port 212 may include one or more couplers with check valves that are closed unless those couplers are coupled to transfer tube 210 and drinking tube 214. For example, deck port 212 may include an external female coupler with a check valve that is opened when the female coupler is coupled to a male coupler of drinking tube 214. In this manner, when drinking tube 214 is decoupled from deck port 212, the forward deck remains sealed. In other examples, deck port 212 could be replaced with a skirt port, that is, a port formed in the skirt worn by paddler 204.

Also shown is a pressurize 218 configured to couple to deck port 212 once paddler 204 decouples drinking tube 214 from deck port 212. Prior to sealing himself into kayak 202 with the skirt, paddler 204 can fill reservoir 208 with a liquid through a fill port. Once seated in kayak 202, paddler 204 can couple pressurizer 218 to deck port 212 and pressurize reservoir 208. Here, pressurizer 218 includes a squeeze pump. Once pressurized, paddler 204 can decouple pressurizer 218 and recouple drinking tube 214 to deck port 212.

Figure 19:
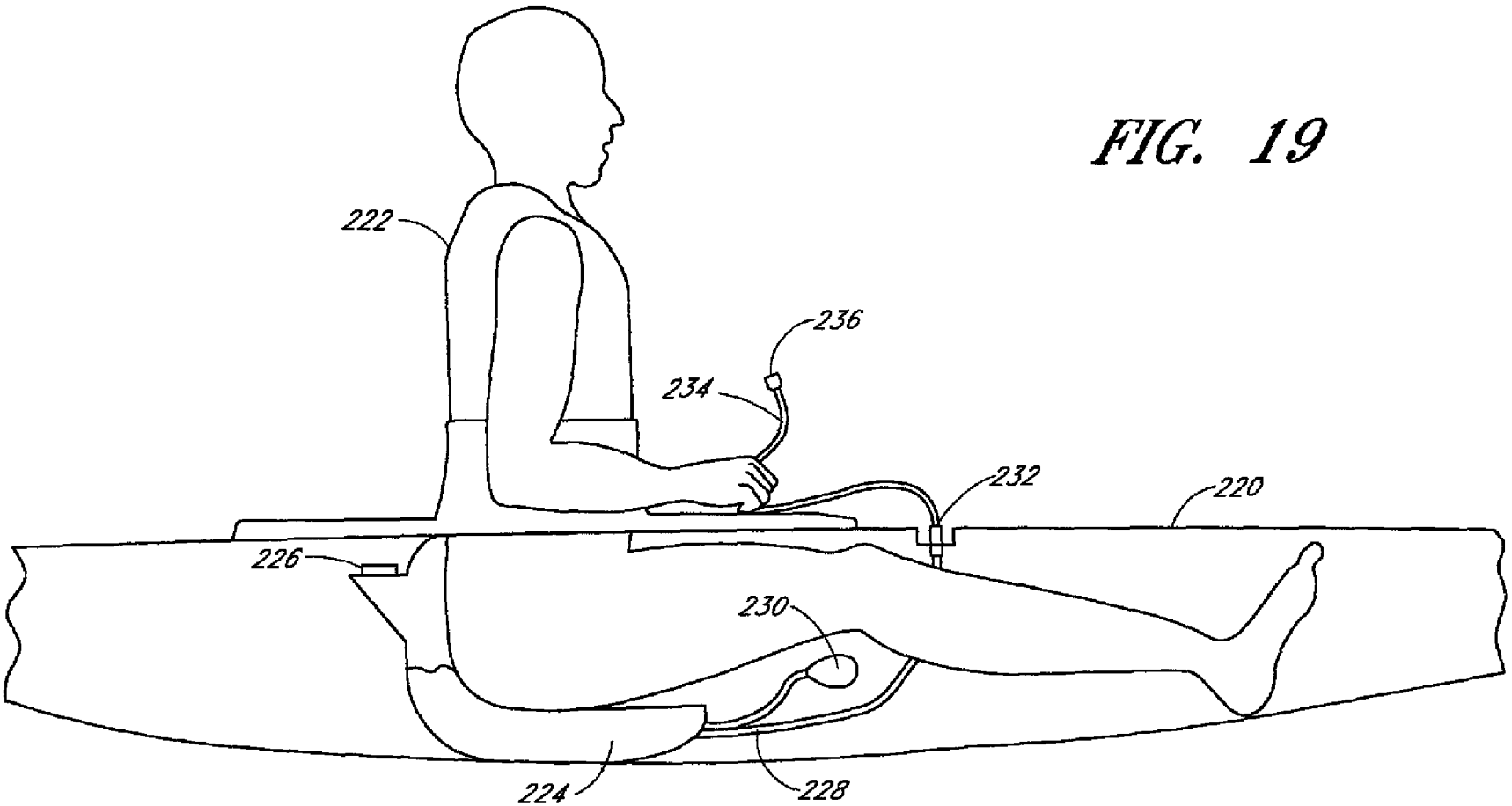

FIG. 19 illustrates a kayak 220 and paddler 222. Paddler 222 is sitting on seat 224 with his legs inserted into the kayak. Paddler 222 is wearing a skirt that provides a seal for preventing water from entering the kayak. While serving an important purpose, the skirt prevents paddler 222 from reaching into kayak 220 and retrieving a beverage.

In the example of FIG. 19, seat 224 also serves as a reservoir for containing a liquid for drinking. In this example, seat 224 includes a fill port 226 through which paddler 222 can pour a liquid into an internal compartment within seat 224. Transfer tube 192 extends from an exit port on seat 224. Pressurizer 230 extends from a pressure port on seat 224. Prior to sealing himself into kayak 220 with the skirt, paddler 226 can fill the internal compartment of seat 224 with a liquid. Paddler 222 can then pressurize that compartment using pressurizer 230. Here, pressurizer 230 includes a squeeze pump.

Kayak 220 is shown to include a recessed deck port 232 on its forward deck. Deck port 232 represents generally any structure configured to allow fluid to flow from seat 224 through transfer tube 228 and pass out of kayak 220. Along these lines, transfer tube 228 is connected to deck port 232 within the interior of kayak 220 creating a fluid flow path between seat 224 and deck port 232. Drinking tube 234 connects to deck port 232 outside kayak 220 and includes a valve 236. When the internal compartment of seat 224 is pressurized, paddler 222 can bite down on valve 236 allowing the liquid contents of seat 224 to be forced though tubes 228 and 234 and expelled out of valve 236.

Deck port 232 may include one or more couplers with check valves that are closed unless those couplers are coupled to transfer tube 228 and drinking tube 234. For example, deck port 232 may include an external female coupler with a check valve that is opened when the female coupler is coupled to a male coupler of drinking tube 234. In this manner, when drinking tube 234 is decoupled from deck port 232, the forward deck remains sealed. In other examples, deck port 232 could be replaced with a skirt port, that is, a port formed in the skirt worn by paddler 222.

Figure 20:
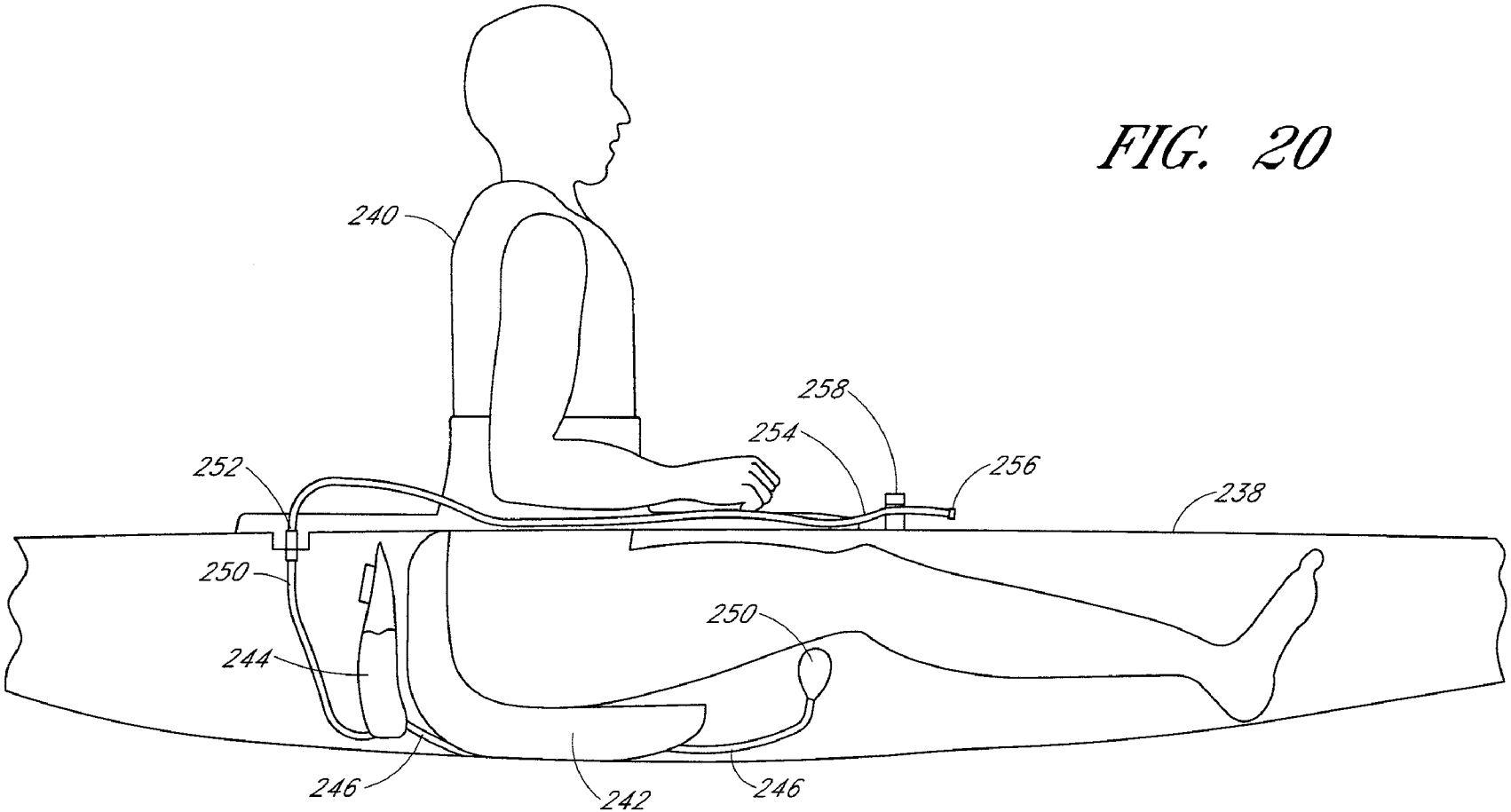

FIG. 20 illustrates a kayak 238 and paddler 240. Paddler 240 is sitting on seat 242 with his legs inserted into the kayak. Paddler 240 is wearing a skirt that provides a seal for preventing water from entering the kayak. While serving an important purpose, the skirt prevents paddler 240 from reaching into kayak 238 and retrieving a beverage.

In the example of FIG. 20, reservoir 244 is positioned within kayak 238. While shown as being hung behind seat 242, reservoir 240 can be placed anywhere within the interior of kayak 238. Transfer tubes 246 and 248 extend from one or more exit ports on reservoir 244. Pressurizer 250, in the form of a squeeze pump, is coupled to transfer tube 246. Kayak 238 is shown to include a recessed deck port 252 on its rear deck. Deck port 252 represents generally any structure configured to allow fluid to flow from reservoir 244 through transfer tube 248 and pass out of kayak 238. Along these lines, transfer tube 248 is connected to deck port 252 within the interior of kayak 238 creating a fluid flow path between reservoir 244 and deck port 252. Drinking tube 254 connects to deck port 252 outside kayak 238 and includes a valve 256. When pressurizer 250 is used to pressurize reservoir 244, paddler 240 can bite down on valve 256 allowing the liquid contents of reservoir 244 to be forced though tubes 248 and 254 and expelled out of valve 256. When not in use, clamp 258, affixed to the deck of kayak 238, can be used to secure drinking tube 254.

Clamp 258 is positioned to be within reach of paddler 240. In a particular example, deck port 252 is positioned to one side of the rear deck of kayak 260. Clamp 258 is positioned on the same side of the deck but either beside paddler 240 or further forward on the deck of kayak 238. In this manner, drinking tube 254 can rest on the deck at the paddler's side when not in use.

Deck port 252 may include one or more couplers with check valves that are closed unless those couplers are coupled to transfer tube 248 and drinking tube 254. For example, deck port 252 may include an external female coupler with a check valve that is opened when coupled to a male coupler of drinking tube 254. In this manner, when drinking tube 254 is decoupled from deck port 252, the rear deck remains sealed. In other examples, deck port 252 could be replaced with a skirt port, that is, a port formed in the skirt worn by paddler 240.

Figure 21:
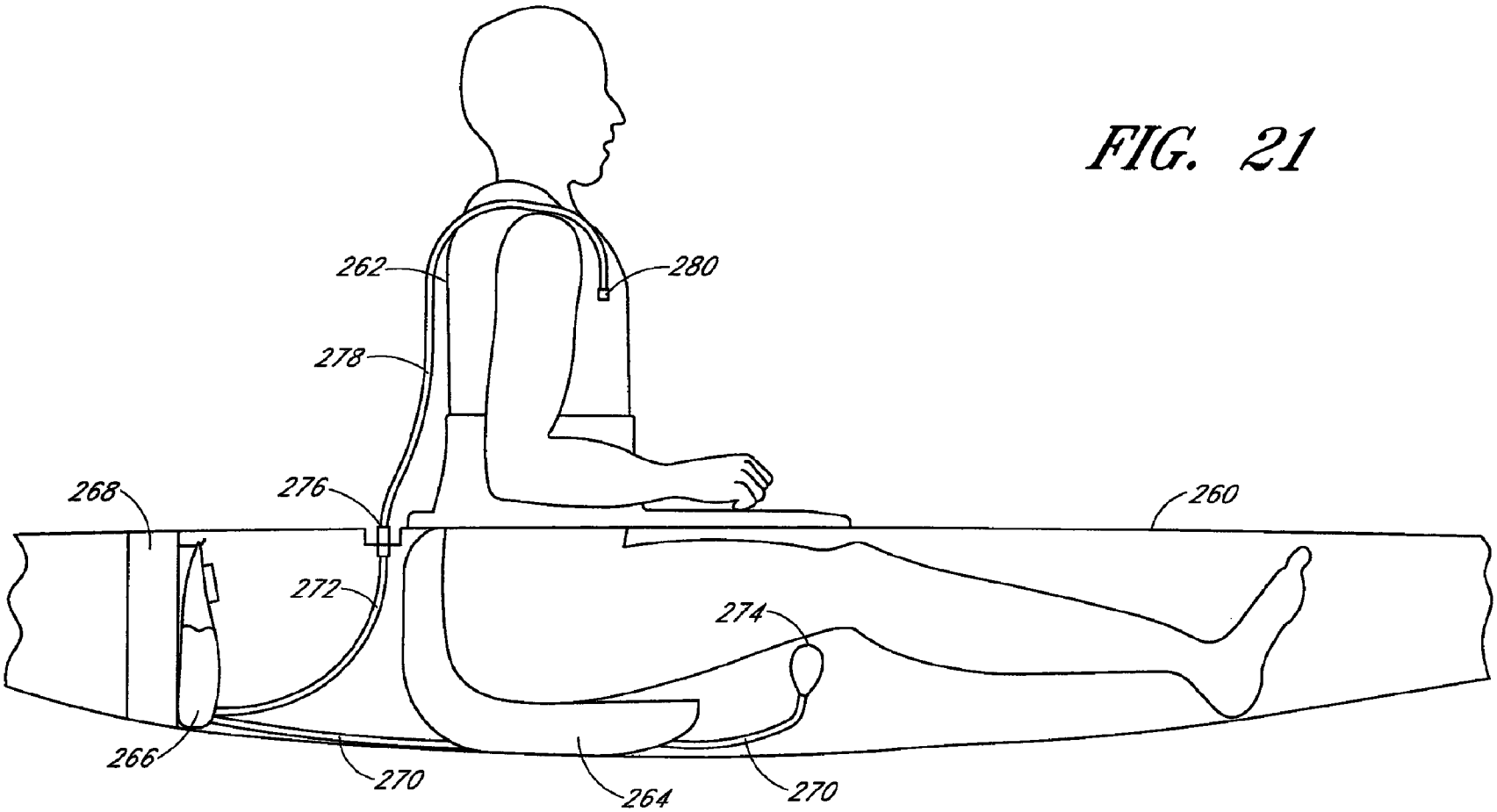

FIG. 21 illustrates a kayak 260 and paddler 262. Paddler 262 is sitting on seat 264 with his legs inserted into the kayak. Paddler 262 is wearing a skirt that provides a seal for preventing water from entering the kayak. While serving an important purpose, the skirt prevents paddler 262 from reaching into kayak 264 and retrieving a beverage.

In the example of FIG. 21, reservoir 266 is positioned within kayak 238 adjacent to rear bulkhead 268. While shown as being hung from rear bulkhead 268, reservoir 262 can be positioned in any desirable manner within the interior of kayak 260. Transfer tubes 270 and 272 extend from one or more exit ports on reservoir 266. Pressurizer 274, in the form of a squeeze pump, is coupled to transfer tube 270. Kayak 260 is shown to include a recessed deck port 276 on its rear deck. Deck port 276 represents generally any structure configured to allow fluid to flow from reservoir 266 through transfer tube 272 and pass out of kayak 260. Along these lines, transfer tube 272 is connected to deck port 276 within the interior of kayak 260 creating a fluid flow path between reservoir 266 and deck port 276. Drinking tube 278 connects to deck port 276 outside kayak 260 and includes a valve 280. When pressurizer 274 is used to pressurize reservoir 266, paddler 262 can bite down on valve 280 allowing the liquid contents of reservoir 266 to be forced though tubes 272 and 278 and expelled out of valve 280. When not in use, drinking tube 262 hangs over a shoulder of paddler 262 and may be held by a clamp on paddler's life vest.

In a particular example, deck port 252 is positioned along the center longitudinal axis of the read deck of kayak 260 at a position close behind paddler 262. This allows drinking tube 278 to conveniently pass up the paddler's back and over the paddler's shoulder placing valve 280 within easy access.

Deck port 276 may include one or more couplers with check valves that are closed unless those couplers are coupled to transfer tube 272 and drinking tube 278. For example, deck port 276 may include an external female coupler with a check valve that is opened when coupled to a male coupler of drinking tube 278. In this manner, when drinking tube 278 is decoupled from deck port 276, the rear deck remains sealed. In other examples, deck port 276 could be replaced with a skirt port, that is, a port formed in the skirt worn by paddler 262.

Conclusion: The various examples discussed above allow for the pressurization of a hydration system where that pressurization functions to more pressurized efficiently expel liquid from a reservoir. Pressurization can be achieved through a variety of techniques including the use of pressurized gas cartridges and manual bulb type pumps. Where pressurized cartridges are used, the escaping gasses can be used to cool a reservoir's contents. Furthermore, the reservoir can be worn as part of a pack or even integrated into a vehicle such as a kayak.

What is claimed is:

1. A hydration system for kayak integration, comprising:

a deck port configured to allow fluid passage through a deck of a kayak;

a reservoir having an internal sealable compartment configured to contain a liquid under pressure, the reservoir having a first port configured to receive pressurizing gasses into the compartment, a second port, and a third port through which the liquid can be supplied into the compartment;

a transfer tube having a first end configured to be coupled to the second port of the reservoir and a second end configured to be coupled to the deck port at a position within an interior space of the kayak;

a pressurizer configured to be coupled to the first port of the reservoir, the pressurizer operable to supply the pressurizing gasses; and a drinking tube having a first end with a valve and a second end, the second end configured to be coupled to the deck port at a position exterior to the kayak.

wherein, when the compartment is sealed and pressurized, activation of the valve unseals the compartment and allows the liquid to be expelled from the compartment via the second port, the transfer tube, and the drinking tube as a result of the pressurization of the compartment by the pressurizing gasses, wherein the reservoir is in a seat positioned in the interior space of the kayak, the seat having an interior space that defines the compartment.

2. The system of claim 1, wherein the reservoir comprises opposing flexible walls forming a bladder defining the sealable compartment and a baffle connecting the opposing walls within the compartment, the baffle configured to oppose expansion of the bladder as the pressurizing gasses are introduced into the compartment.

3. The system of claim 2, wherein:

the first port is formed in one of the opposing walls and is configured to provide an ingress for the pressurizing gasses through that wall and into the compartment through that wall;

the second port is formed in one of the opposing walls and is configured to provide an egress for the liquid to pass from the compartment through that wall and into the transfer tube; and the third port is formed in one of the opposing walls and is configured to provide an ingress for the liquid through that wall and into the compartment.

4. The system of claim 1, wherein the third port includes a cap configured to close the third port and wherein the first port is formed in the cap and is configured to provide an ingress for the pressurizing gasses through the cap into the compartment when the cap is closing the third port.

5. The system of claim 1, wherein the pressurizer includes a squeeze pump configured such that when manually squeezed, the squeeze pump expels pressurizing gasses into the compartment via the first port.

6. The system of claim 1, wherein the pressurizer is configured to detachably couple to the first port.

7. The system of claim 6, wherein the first port and the second port are superposed to allow common fluid communication between the first port, the second port and the compartment.

8. The hydration system of claim 7, wherein:

the deck port includes a first coupler;

the pressurizer includes a second coupler configured to detachably couple with the first coupler; and the second end of the drinking tube includes a third coupler configured to detachably couple with the first coupler.

9. The system of claim 7, wherein:

the first end of the drinking tube includes a first coupler;

the valve includes a second coupler configured to detachably couple with the first coupler; and the pressurizer includes a third coupler configured to detachably couple with the first coupler.

10. A kayak, comprising:

an interior space in which a paddler is able to be positioned;

a deck;

a deck port configured to allow fluid passage through the deck from the interior space;

a reservoir having an internal sealable compartment configured to contain a liquid under pressure, the reservoir having a first port configured to receive pressurizing gasses into the compartment, a second port, and a third port through which the liquid can be supplied into the compartment;

a transfer tube having a first end configured to be coupled to the second port of the reservoir and a second end configured to be coupled to the deck port at a position within the interior space;

a pressurizer configured to be coupled to the first port of the reservoir, the pressurizer operable to supply the pressurizing gasses; and a drinking tube having a first end with a valve and a second end, the second end configured to be coupled to the deck port at a position exterior to the kayak;

wherein, when the compartment is sealed and pressurized, activation of the valve unseals the compartment and allows the liquid to be expelled from the compartment via the second port, the transfer tube, and the drinking tube as a result of the pressurization of the compartment by the pressurizing gasses, wherein the reservoir is in a seat positioned in the interior space of the kayak, the seat having an interior space that defines the compartment.

11. The system of claim 10, wherein the reservoir comprises opposing flexible walls forming a bladder defining the sealable compartment and a baffle connecting the opposing walls within the compartment, the baffle configured to oppose expansion of the bladder as the pressurizing gasses are introduced into the compartment.

12. The system of claim 11, wherein:

the first port is formed in one of the opposing walls and is configured to provide an ingress for the pressurizing gasses through that wall and into the compartment through that wall;

the second port is formed in one of the opposing walls and is configured to provide an egress for the liquid to pass from the compartment through that wall and into the transfer tube; and the third port is formed in one of the opposing walls and is configured to provide an ingress for the liquid through that wall and into the compartment.

13. The system of claim 10, wherein the third port includes a cap configured to close the third port and wherein the first port is formed in the cap and is configured to provide an ingress for the pressurizing gasses through the cap into the compartment when the cap is closing the third port.

14. The system of claim 10, wherein the pressurizer includes a squeeze pump configured such that when manually squeezed, the squeeze pump expels pressurizing gasses into the compartment via the first port.

15. The system of claim 10, wherein the pressurizer is configured to detachably couple to the first port.

16. The system of claim 15, wherein the first port and the second port are superposed to allow common fluid communication between the first port, the second port and the compartment.

17. The hydration system of claim 16, wherein:

the deck port includes a first coupler;

the pressurizer includes a second coupler configured to detachably couple with the first coupler; and the second end of the drinking tube includes a third coupler configured to detachably couple with the first coupler.

18. The system of claim 16, wherein:

the first end of the drinking tube includes a first coupler;

the valve includes a second coupler configured to detachably couple with the first coupler; and the pressurizer includes a third coupler configured to detachably couple with the first coupler.

* * * * *

UNITED STATES PATENT AND TRADEMARK OFFICE

CERTIFICATE OF CORRECTION

PATENT NO. : 7,971,549 B2
APPLICATION NO. : 12/191254
DATED : July 5, 2011
INVENTOR(S) : Jeff Skillern and James H. Sadler It is certified that error appears in the above-identified patent and that said Letters Patent is hereby corrected as shown below:

Title Page, (Item 73) Assignee, on Line 1, change "Fotthill Ranch," to --Foothill Ranch,--.

Title Page, (Item 60) Related U.S. Application Data, on Line 2, change "13, 2007." to --13, 2007, provisional application No. 60/822,273, filed on Aug. 14, 2006. --.

At Column 2, Line 31, change "removeably" to --removably--.

At Column 5, Line 55, change "port 1322" to --port 132--.

At Column 10, Line 38, in Claim 1, change "kayak." to --kayak;--.

Signed and Sealed this
Twenty-fourth Day of January, 2012

David J. Kappos

David J. Kappos
*Director of the United States Patent and Trademark Office*